US007566223B2

(12) United States Patent
Wadsworth

(10) Patent No.: US 7,566,223 B2
(45) Date of Patent: Jul. 28, 2009

(54) ELECTRICAL CONNECTOR AND METHOD OF MANUFACTURING SAME

(75) Inventor: John Wadsworth, Burbank, CA (US)

(73) Assignee: Belkin International, Inc., Compton, CA (US)

( * ) Notice: Subject to any disclaimer, the term of this patent is extended or adjusted under 35 U.S.C. 154(b) by 64 days.

(21) Appl. No.: 11/788,736

(22) Filed: Apr. 20, 2007

(65) Prior Publication Data

US 2008/0261430 A1 Oct. 23, 2008

(51) Int. Cl.
*H01R 39/00* (2006.01)

(52) U.S. Cl. ..... 439/21

(58) Field of Classification Search ..... 439/21, 439/20–26, 27, 28, 640, 106, 11
See application file for complete search history.

(56) References Cited

U.S. PATENT DOCUMENTS

| | | | |
|---|---|---|---|
| 1,238,448 | A | 8/1917 | Shaw |
| 1,613,647 | A | 1/1927 | Davies et al. |
| 1,699,722 | A | 1/1929 | Stott |
| 1,699,958 | A | 1/1929 | Eby |
| 1,714,763 | A | 5/1929 | Boyson |
| 1,817,004 | A | 8/1931 | Hubbell, Jr. |
| 1,846,251 | A | 1/1932 | Donahue |
| 1,873,042 | A | 8/1932 | Rohrdanz |
| 1,950,036 | A | 3/1934 | Preston |
| 1,975,964 | A | 10/1934 | Mayhew |
| 1,978,805 | A | 10/1934 | McCloy et al. |
| 1,981,458 | A | 11/1934 | McCloy et al. |
| 1,984,181 | A | 12/1934 | French |
| 2,027,447 | A | 1/1936 | Percy |
| 2,226,209 | A | 12/1940 | Rizutto |
| 2,301,258 | A | 11/1942 | Corlew |
| 2,305,100 | A | 12/1942 | O'Brien |
| 2,305,101 | A | 12/1942 | O'Brien |
| 2,326,181 | A | 8/1943 | Sundquist et al. |
| 2,425,679 | A | 8/1947 | Jackson |
| 2,433,938 | A | 1/1948 | Varner |
| 2,447,026 | A | 8/1948 | O'Brien |
| 2,474,070 | A | 6/1949 | Sokolik |
| 2,542,609 | A | 2/1951 | Wyglendowski |
| 2,542,935 | A | 2/1951 | McElroy |
| 2,564,159 | A | 8/1951 | Greacen, Jr. |
| 2,570,784 | A | 10/1951 | Ferguson |
| 2,645,759 | A | 7/1953 | Solari |

(Continued)

OTHER PUBLICATIONS

360 Electrical—It's Revolutionary!; http://www.360electrical.com/index-1.html; Apr. 12, 2007 1 page.

(Continued)

*Primary Examiner*—Alexander Gilman
(74) *Attorney, Agent, or Firm*—Bryan Cave LLP

(57) ABSTRACT

An electrical connector (100) includes: (a) two or more conductors (120, 122, 124), each conductor of the two or more conductors has an inner radius (775) and an inner surface (721, 723, and 725) along the inner radius; (b) two or more electrical prongs (110, 112, 114), each prong of the two or more electrical prongs contacts and is electrically coupled to the inner surface of one of the two or more conductors; and (c) a housing (130) having a first portion (132) and enclosing the two or more conductors and a first portion of each of the two or more electrical prongs.

15 Claims, 16 Drawing Sheets

U.S. PATENT DOCUMENTS

| | | | | |
|---|---|---|---|---|
| 2,654,869 | A | 10/1953 | Mudd, Jr. | |
| 2,855,578 | A | 10/1958 | Hirsch | |
| 2,869,102 | A | 1/1959 | Hubbell, Jr. | |
| 2,892,172 | A | 6/1959 | McGann, Jr. | |
| 2,894,242 | A | 7/1959 | Bickford et al. | |
| 2,898,572 | A | 8/1959 | Shinn | |
| 3,032,740 | A | 5/1962 | Von Hoorn | |
| 3,045,201 | A | 7/1962 | Hall | |
| 3,137,536 | A | 6/1964 | Healy | |
| 3,335,395 | A | 8/1967 | Smith | |
| 3,355,695 | A | 11/1967 | Overesch | |
| 3,392,362 | A | 7/1968 | Lipinski | |
| 3,474,376 | A | 10/1969 | Preiss | |
| 3,479,632 | A | 11/1969 | Galles | |
| 3,718,890 | A | 2/1973 | Sheldon | |
| 3,747,049 | A | 7/1973 | Cressman et al. | |
| 3,760,338 | A | 9/1973 | Bruels | |
| 3,860,312 | A | 1/1975 | Gordon, Jr. | |
| 3,873,951 | A | 3/1975 | Blake | |
| 3,950,069 | A | 4/1976 | Wiley | |
| 3,975,075 | A | 8/1976 | Mason | |
| 4,026,618 | A | 5/1977 | Straka | |
| D246,241 | S | 11/1977 | Jacobs | |
| 4,086,643 | A | 4/1978 | Jacobs | |
| 4,307,925 | A | 12/1981 | Drew | |
| D270,628 | S | 9/1983 | Bobrovniczky | |
| 4,484,185 | A | 11/1984 | Graves | |
| 4,488,201 | A | 12/1984 | Webb et al. | |
| D280,894 | S | 10/1985 | Dickey | |
| 4,567,544 | A | 1/1986 | Ronemus et al. | |
| 4,643,508 | A | 2/1987 | Schaller | |
| 4,679,884 | A | 7/1987 | Klemp | |
| 4,771,367 | A | 9/1988 | Serr et al. | |
| 4,857,013 | A | 8/1989 | Peters | |
| 4,927,376 | A | 5/1990 | Dickie | |
| 5,114,352 | A | 5/1992 | Gahagen et al. | |
| 5,249,970 | A | 10/1993 | Jennings | |
| 5,399,093 | A | 3/1995 | Schneider et al. | |
| 5,595,503 | A | 1/1997 | Pittman et al. | |
| 5,775,921 | A * | 7/1998 | Chou | 439/21 |
| 6,595,782 | B1 * | 7/2003 | Hsiao | 439/13 |
| 7,063,563 | B1 | 6/2006 | Hsu | |
| 7,255,568 | B1 * | 8/2007 | Wu | 439/23 |
| 7,462,074 | B1 * | 12/2008 | Devlin et al. | 439/640 |
| 2006/0030168 | A1 | 2/2006 | Miura | |

OTHER PUBLICATIONS

360 Electrical—It's Revolutionary!; http://www.360electrical.com/index-2.html; Apr. 12, 2007 1 page.

360 Electrical—It's Revolutionary!; http://www.360electrical.com/index-3.html; Apr. 12, 2007 1 page.

Belkin 6-Socket SurgeMaster@Superior Series with Telephone Protection; http://catalog.belkin.com/IWCatProductPage.process?Product_ID=135152; 3 pages.

* cited by examiner

FIG. 10
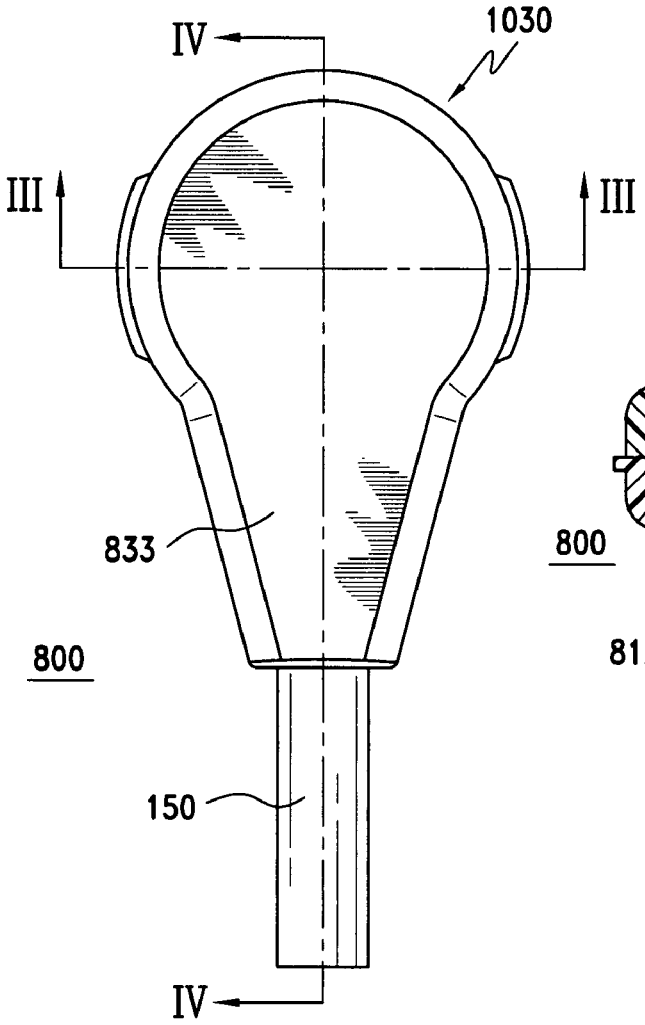
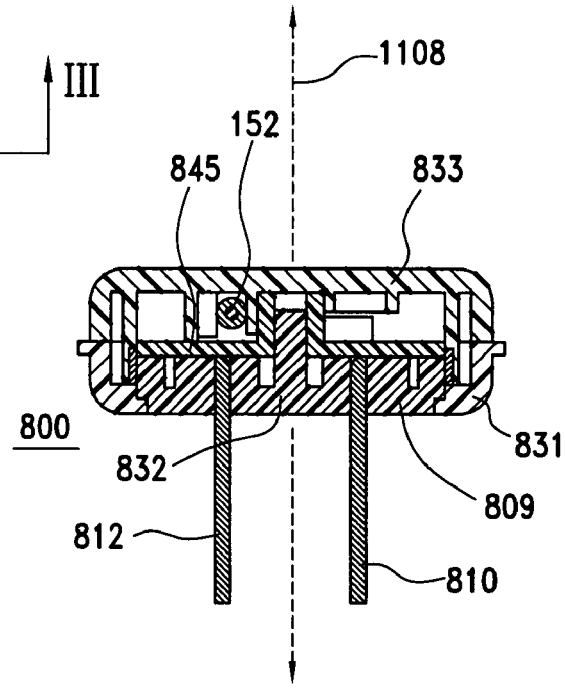
FIG. 11
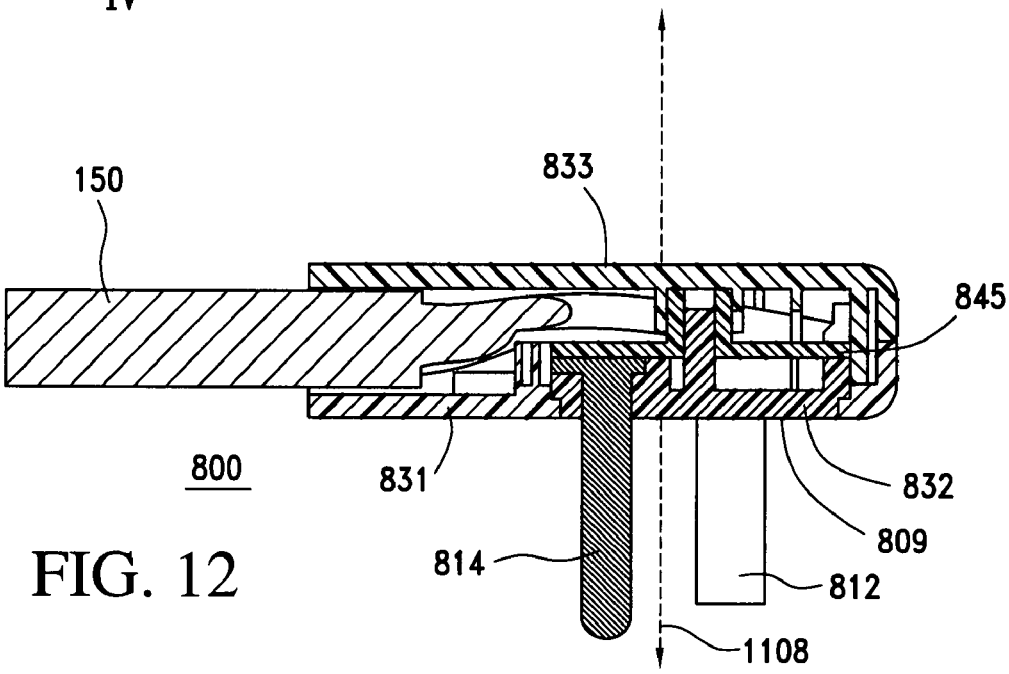
FIG. 12

FIG. 15
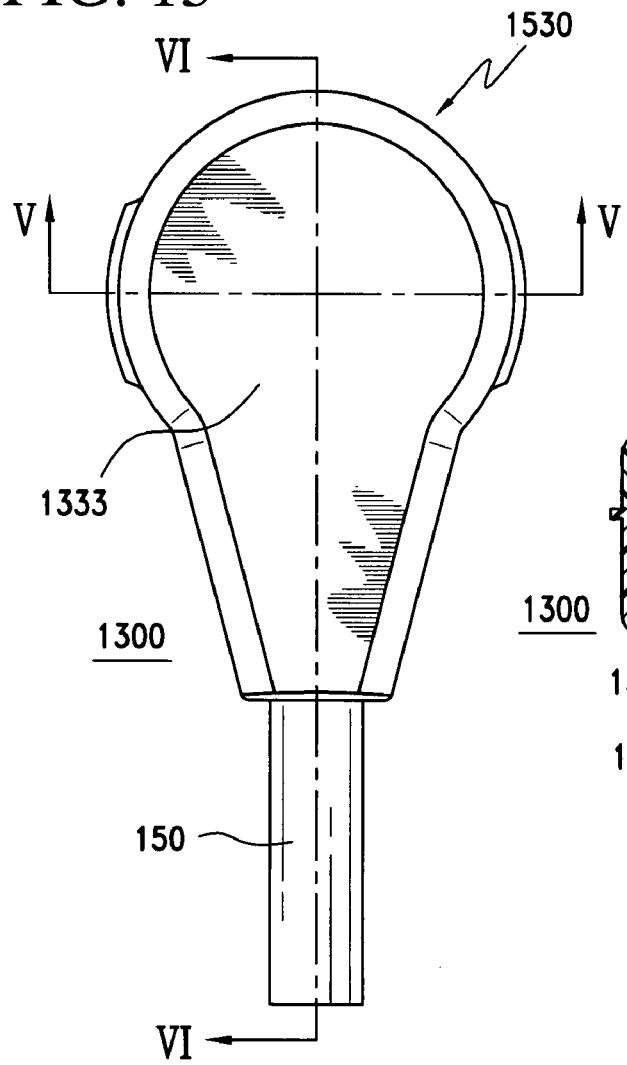
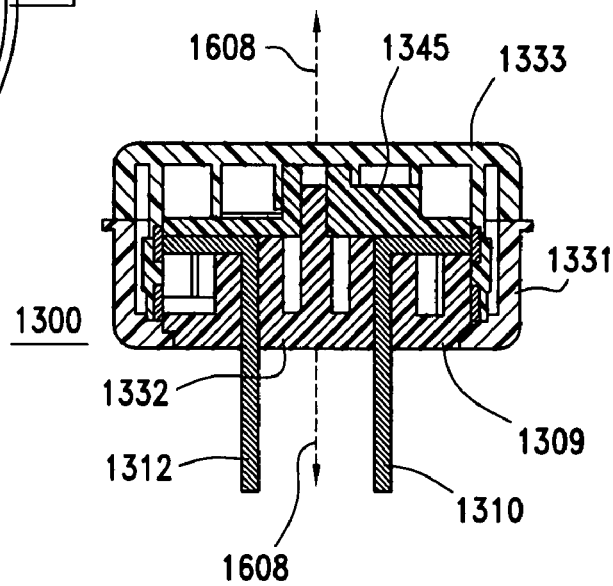
FIG. 16
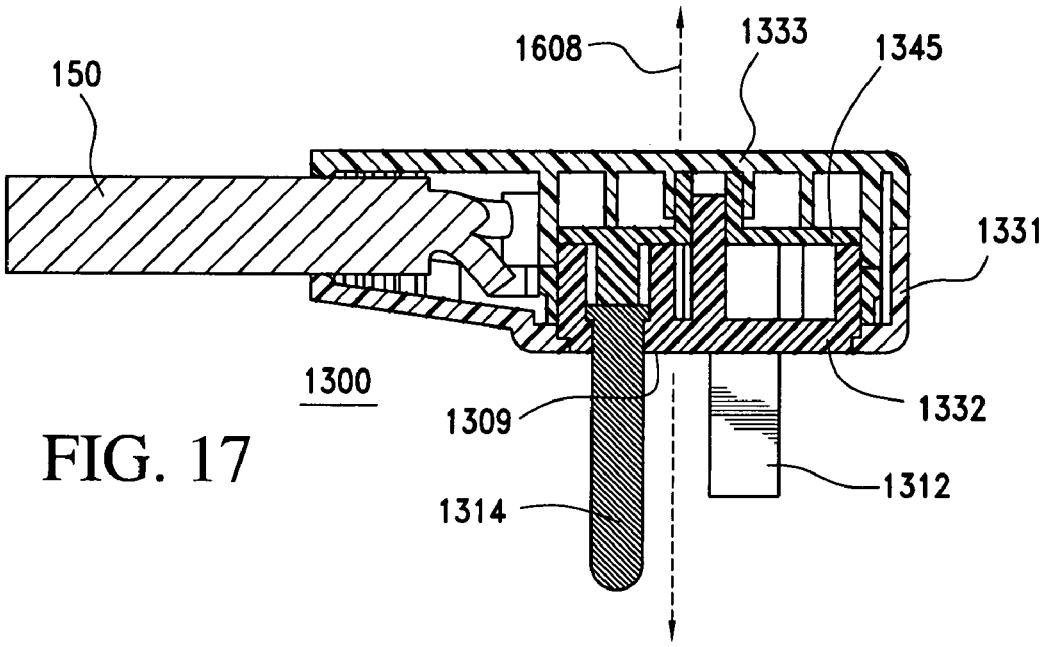
FIG. 17

ELECTRICAL CONNECTOR AND METHOD OF MANUFACTURING SAME

FIELD OF THE INVENTION

This invention relates generally to electrical connectors, and relates more particularly to rotatable electrical plugs.

BACKGROUND OF THE INVENTION

Ordinary electrical plugs are undesirable in some circumstances because they typically include a housing, which protrudes a substantial distance from the wall after the plug is inserted into an electrical outlet. This protrusion makes the plug susceptible to unintentional disengagement by moving objects and also prevents furniture and other objects from being placed close to the wall.

Over the years, people have developed a variety of electrical plugs that have low profile housings. Low profile electrical plugs offer the advantage of having a reduced housing profile in comparison to ordinary electrical plugs. Accordingly, they are less susceptible to unintentional disengagement and permit objects to be placed closer to the wall than is possible with ordinary electrical plugs.

In most low profile electrical plugs, the power cord exits the electrical plug perpendicular to the electrical prongs so as to decrease the profile of the electrical plug's housing. Hence, when the electrical plug is inserted into an electrical outlet, the power cord exits the electrical plug housing parallel to the face of the electrical outlet. In some circumstances, however, consumers find these electrical plugs undesirable because the power cord blocks other receptacles in the electrical outlet, and thereby preventing additional electrical plugs from being inserted into the electrical outlet. This problem is more pronounced with polarized electrical plugs or plugs incorporating a ground prong because these electrical plugs can only be inserted into the electrical outlet in one orientation.

These problems can be addressed by an electrical plug design in which the cord rotates with respect to the prongs. In addition to addressing the aforementioned problems, a rotatable electrical plug allows the electrical device connected to the electrical plug to move relative to the electrical outlet without imparting excessive force on the prongs of the electrical plug.

Numerous designs for rotatable electrical plugs exist. However, some designs for rotatable electrical plugs are costly to manufacture and fail to meet applicable safety standards, such as those established by the Underwriters Laboratories, Inc. (UL). Still other designs for rotatable electrical plugs do not provide for more than two electrical prongs or can impose excessive bending forces on the power cord coupled to the electrical plug.

Accordingly, a need exists for a rotatable connector that provides a reduced profile, long operating life, and a reduction in manufacturing costs.

BRIEF DESCRIPTION OF THE DRAWINGS

The invention will be better understood from a reading of the following detailed description of examples of embodiments, taken in conjunction with the accompanying figures in the drawings in which:

FIG. 10 illustrates a back view of the electrical connector of FIG. 8, according to the second embodiment;

FIG. 11 illustrates a cross-sectional view along the III-III line of FIG. 10 of the electrical connector of FIG. 8, according to the second embodiment;

FIG. 12 illustrates a cross-sectional view along the IV-IV line of FIG. 10 of the electrical connector of FIG. 8, according to the second embodiment;

FIG. 15 illustrates a back view of the electrical connector of FIG. 13, according to the third embodiment;

FIG. 16 illustrates a cross-sectional view along the V-V line of FIG. 15 of the electrical connector of FIG. 13, according to the third embodiment;

FIG. 17 illustrates a cross-sectional view along the VI-VI line of FIG. 15 of the electrical connector of FIG. 13, according to the third embodiment;

Figure 1:
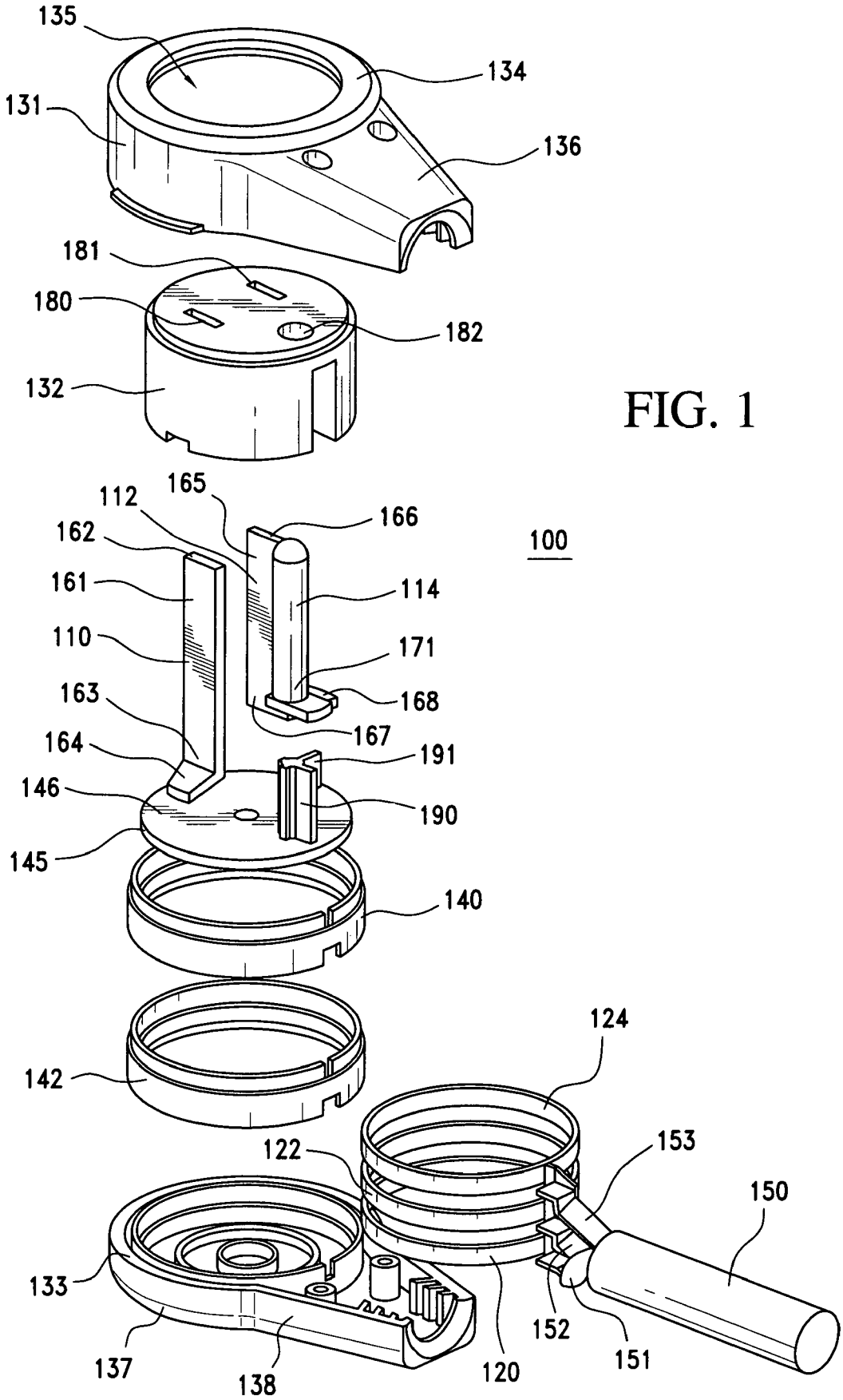
FIG. 1 illustrates an exploded view of an electrical connector, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of examples of embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, physically, mechanical, or other manner. The term "ring," as used herein, includes items with a general annular, elliptical, polygonal, circular, and/or oval shape. Likewise, the term "annular," as used hereafter, includes elliptical, oval, multi-sided polygon, ring, and/or circular shapes.

DETAILED DESCRIPTION OF EXAMPLES OF EMBODIMENTS

In one embodiment, an electrical connector includes: (a) two or more conductors, each conductor of the two or more conductors has an inner radius and an inner surface along the inner radius; (b) two or more electrical prongs, each prong of the two or more electrical prongs contacts and is electrically coupled to the inner surface of one of the two or more conductors; and (c) a housing having a first portion and enclosing the two or more conductors and a first portion of each of the two or more electrical prongs.

In this embodiment, a second portion of each of the two or more electrical prongs is capable of being inserted into an electrical outlet, and the two or more electrical prongs extend out of the first portion of the housing and are capable of being rotated about an axis substantially perpendicular to the first portion of the housing.

In another embodiment, a rotatable electrical plug includes: (a) two or more rings; (b) two or more pins capable of being coupled to an electrical outlet, each pin of the two or more pins is electrically coupled to a different one of the two or more rings; and (c) a casing defining an interior space, the interior space of the casing enclosing the two or more rings and a first portion of each of the two or more pins. In this embodiment, the diameters of each of the two or more rings can be substantially equal to each other, and each of the two or more rings can be concentric with each other.

In yet another embodiment, a method of manufacturing a rotatable electrical connector includes: (a) providing two or more conductors, each conductor of the two or more conductors has an inner radius and an inner surface along the inner radius; (b) providing two or more electrical prongs; (c) coupling each of the two or more electrical prongs to the inner surface of one of the two or more conductors; (d) providing a housing having a first portion; and (d) enclosing the two or more conductors and a portion of the two or more electrical prongs in the housing such that the two or more electrical prongs extend out of the first portion of the housing and are capable of being rotated about an axis substantially perpendicular to the first portion of the housing.

Figure 2:
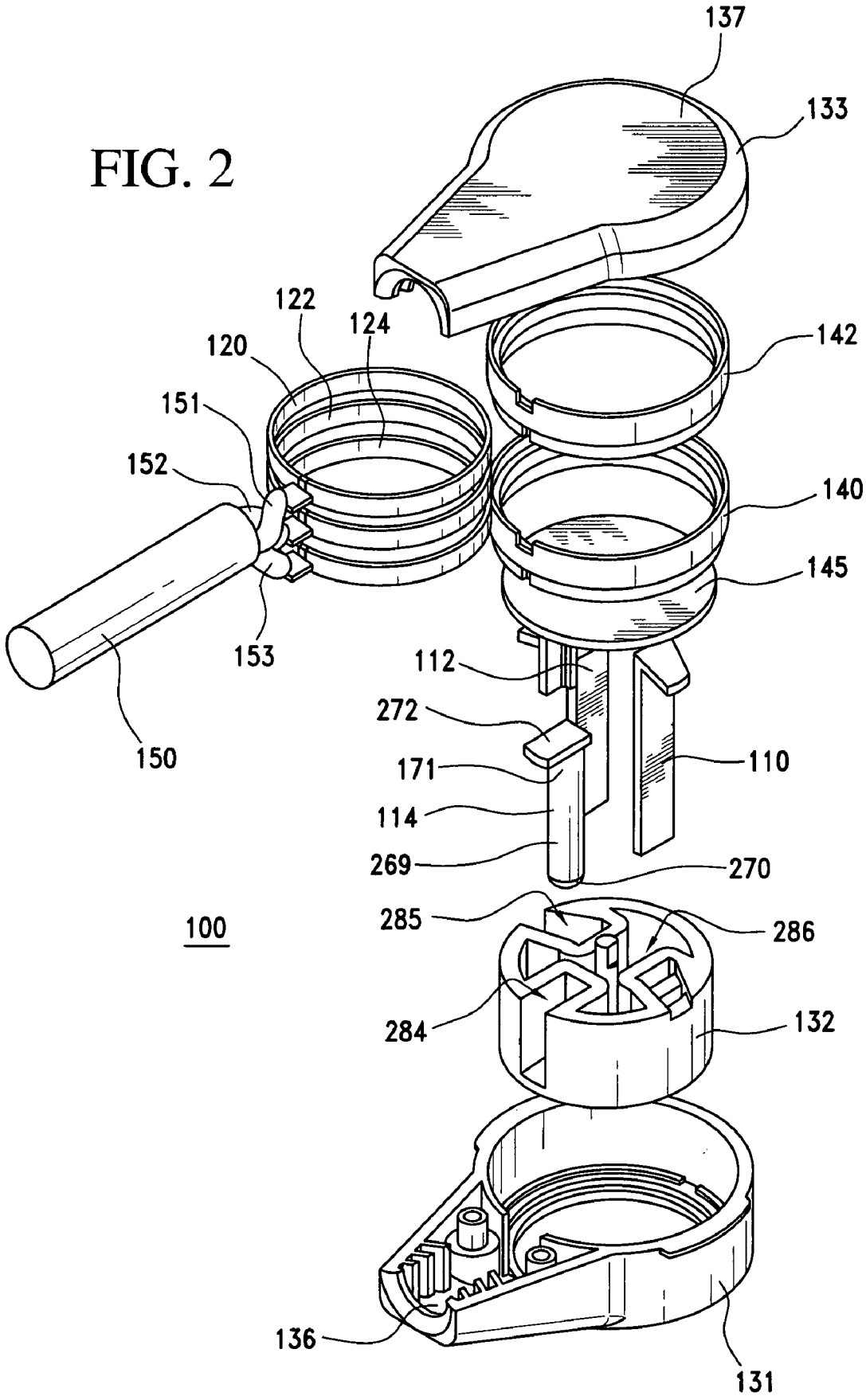
FIG. 2 illustrates another exploded view of the electrical connector of FIG. 1, according to the first embodiment.
Figure 3:
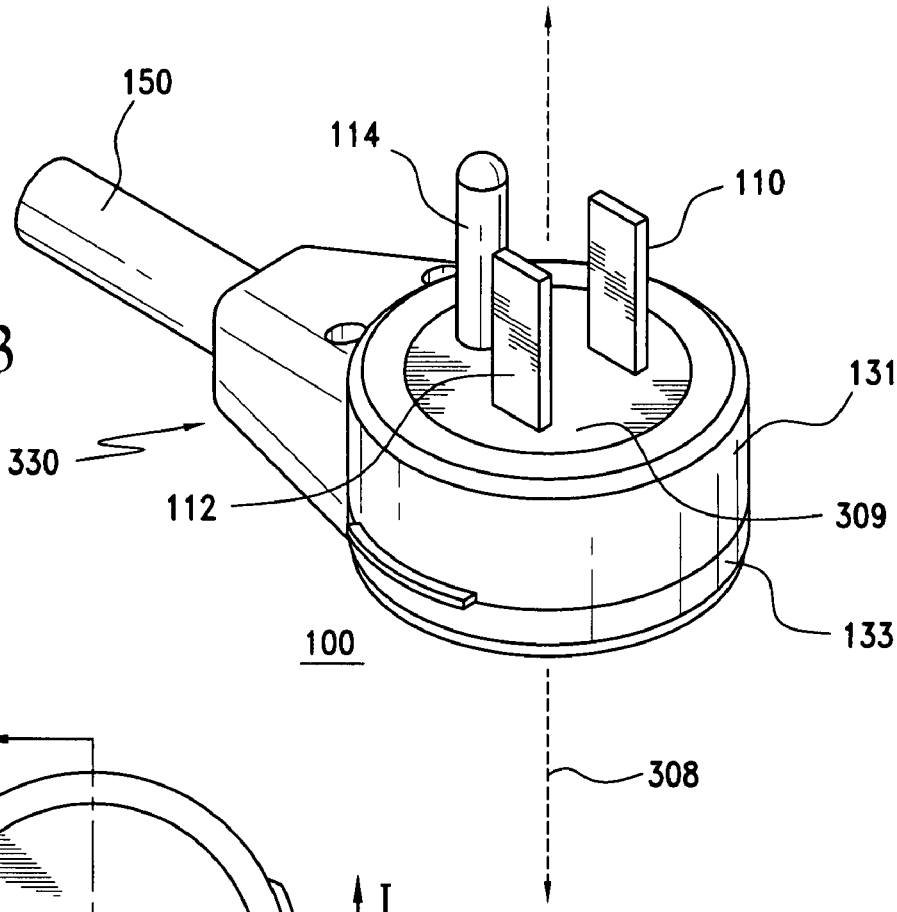
FIG. 3 illustrates a top, front, side isometric view of the electrical connector of FIG. 1, according to the first embodiment.
Figure 4:
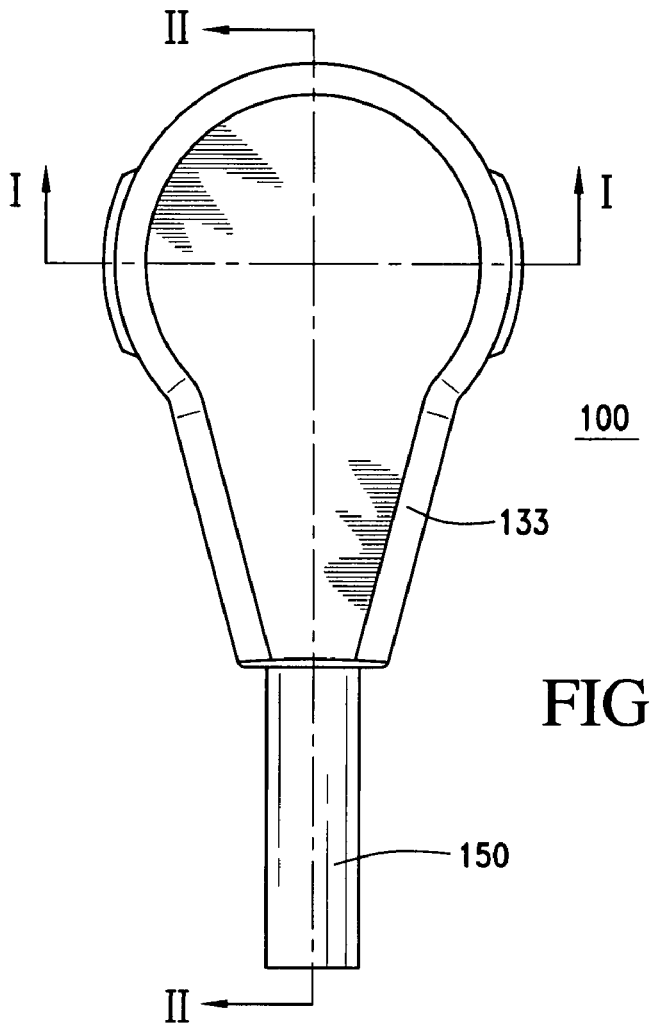
FIG. 4 illustrates a back view of the electrical connector of FIG. 1, according to the first embodiment.
Figure 5:
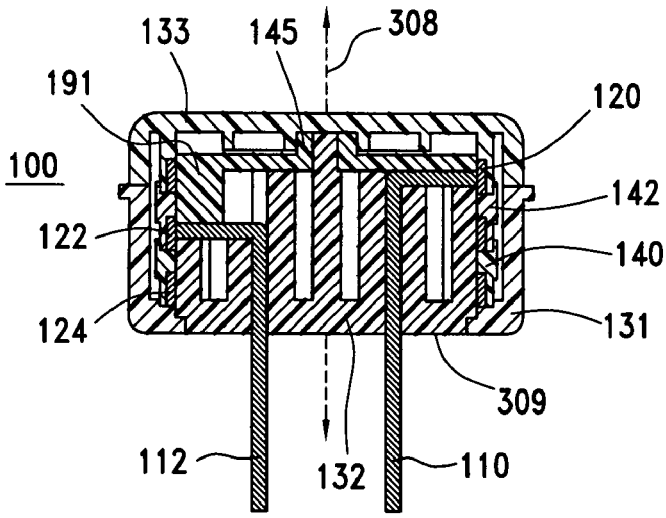
FIG. 5 illustrates a cross-sectional view along the I-I line of FIG. 4 of the electrical connector of FIG. 1, according to the first embodiment.
Figure 6:
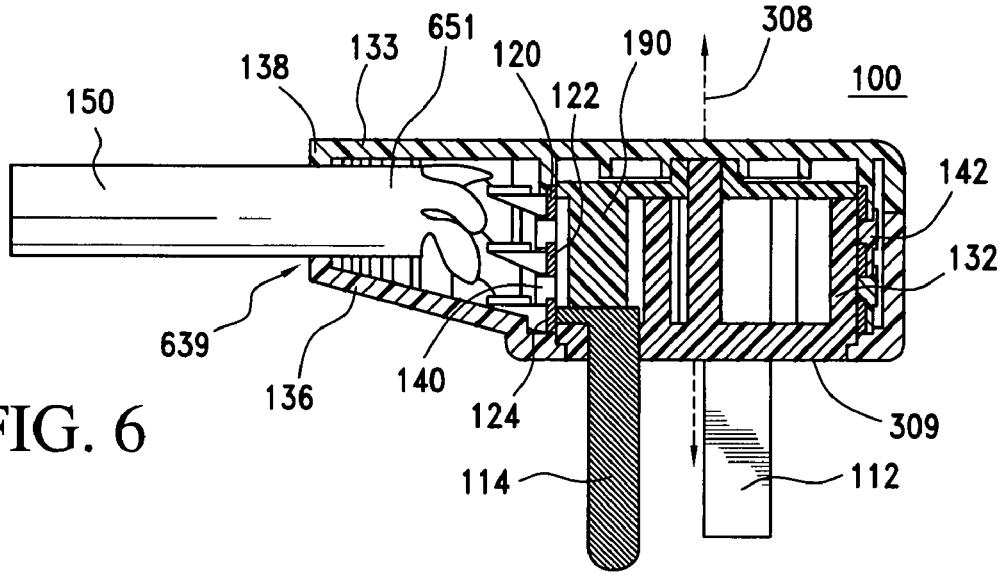
FIG. 6 illustrates a cross-sectional view along the II-II line of FIG. 4 of the electrical connector of FIG. 1, according to the first embodiment.
Figure 7:
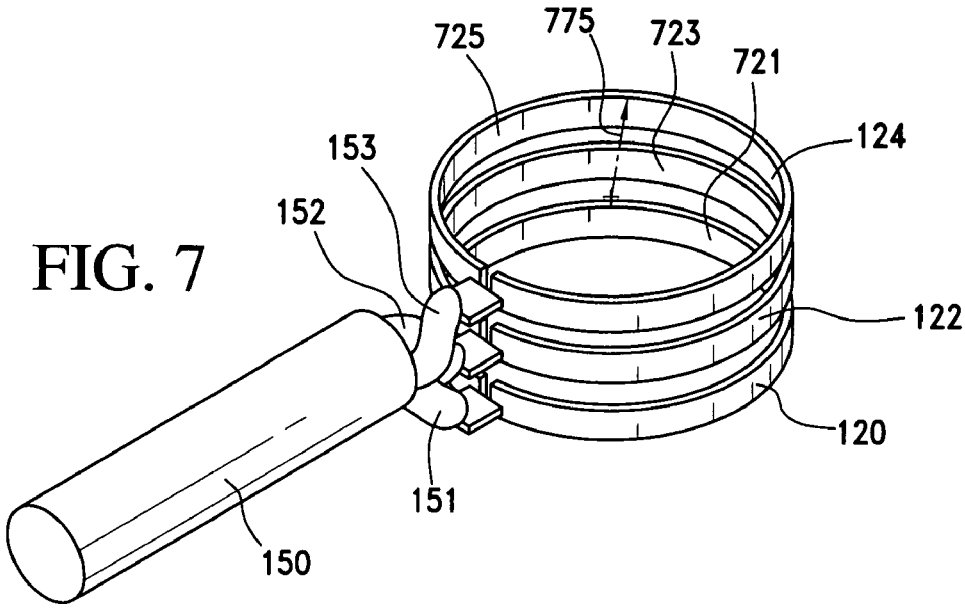
FIG. 7 illustrates an isometric view of conductors and a cable in the electrical connector of FIG. 1, according to the first embodiment.

Turning to the drawings, FIG. 1 illustrates an exploded view of an electrical connector 100, according to a first embodiment. FIG. 2 illustrates another exploded view of electrical connector 100, according to the first embodiment. FIG. 3 illustrates top, front, side isometric view of electrical connector 100, according to the first embodiment. FIG. 4 illustrates a back view of electrical connector 100, according to the first embodiment. FIG. 5 illustrates a cross-sectional view along the I-I line (FIG. 4) of electrical connector 100, according to the first embodiment. FIG. 6 illustrates a cross-sectional view along the II-II line (FIG. 4) of electrical connector 100, according to the first embodiment. FIG. 7 illustrates an isometric view of conductors 120, 122, and 124 and cable 150, according to the first embodiment.

Electrical connector 100 is merely exemplary and is not limited to the embodiments presented herein. Electrical connector 100 can be employed in many different embodiments or examples not specifically depicted or described herein.

In the example shown in FIGS. 1-7, electrical plug or connector 100 can include: (a) one or more electrical pins or prongs 110, 112, and 114; (b) one or more conductors 120, 122, and 124 (c) one or more electrical insulators 140 and 142; (d) a cable 150 having two or more electrical wires 151, 152, and 153; (e) a housing 330 (FIG. 3) with a rotating outer section 132. In one example, electrical wires 151, 152, and 153 are coupled to conductors 120, 122, and 124, respectively.

In one embodiment, when electrical connector 100 is coupled to an alternating current (a.c.) electrical outlet (not shown), rotating outer section 132 and prongs 110, 112, and 114 can be rotated relative to the electrical outlet. Moreover, prongs 110, 112, and 114 can extend out of rotating outer section 132 and are capable of being rotated about an axis 308 (FIGS. 3, 5, and 6) substantially perpendicular to a face portion 309 (FIGS. 3, 5, and 6) of rotating outer section 132. In the embodiment illustrated in FIGS. 1-7, prongs 110, 112, and 114 can be rotated at least three-hundred and sixty degrees about axis 308.

In this embodiment, each of conductors 120, 122, and 124 can have an annular shape and also can have an inner surface 721, 723, and 725 (FIG. 7), respectively. In one example, each of conductors 120, 122, and 124 has an inner radius 775. That is, the radius of conductors 120, 122, and 124 are substantially equal to each other. Inner surfaces 721, 723, and 725 can be along inner radius 775 in some examples. In other examples, two or more of conductors 120, 122, and 124 can have different inner radii. Additionally, any of conductors 120, 122, and 124 can have two radii, as in an ellipse or oval. In one embodiment, conductors 120, 122, and 124 have the same shape. In some embodiments, conductors 120, 124, and 124 can have a non-annular shape. In the same or a different embodiment, conductors 120, 122, and 124 are concentric with each other.

Conductors 120, 122, and 124 can be located within or at least parallel to two or more planes in housing 330. Each of the two or more planes is substantially perpendicular to axis 308. Conductors 120, 122, and 124 are made of a conducting material such as metal.

In one embodiment, insulator 140 can electrically isolate conductor 124 from conductor 122 and vice versa. Likewise, insulator 142 can electrically isolate conductor 122 from conductor 120 and vice versa. In one example, insulator 140 is an isolating ring that is located between conductors 124 and 120, and insulator 142 is an isolating ring that can be placed between conductors 122 and 120.

In some examples, insulators 140 and 142 can be concentric, can have the same radii as conductors 120, 122, and/or 124, and can have the same shape. In some embodiments, insulators 140 and 142 are rubber or plastic. For example, insulators 140 and 142 can be polyvinyl chloride (PVC). In another embodiment, insulators 140 and 142 are ceramic.

In an alternative embodiment, electrical connector 100 does not include insulators 140 and/or 142. Instead, in this embodiment, electrical connector 100 can include an air gap between the conductors 120 and 122, and/or conductors 122 and 124. In this embodiment, the air gap meets the distance requirements of the appropriate regulatory agency for air gap type insulators.

As illustrated in FIGS. 1-7, each of prongs 110, 112, and 114 are capable of being coupled to the electrical outlet and electrically coupled to a different one of conductors 120, 122, and 124, respectively.

In one example, prong 110 can include: (a) an arm 161 having a distal end 162 and a proximal end 163 opposite distal end 162; and (b) a flange 164 coupled to proximal end 163. Prong 112 can include: (a) an arm 165 having a distal end 166 and proximal end 167 opposite distal end 166; and (b) a flange 168 coupled to proximal end 167.

In the same or a different embodiment, prong 114 can include (a) an arm 269 (FIG. 2) having a distal end 270 and a proximal end 171 opposite distal end 270; and (b) a flange 272 coupled to proximal end 171. In the same or a different embodiment, distal ends 162, 166, and 270 of arms 161, 165, and 269, respectively, are capable of being inserted into the electrical outlet.

In some examples, each of prongs 110, 112, and 114 can have a unitary structure. Prongs 110, 112, and 114 are made from a conductive material, such as metal.

In one embodiment, prongs 110, 112, and 114 can contact and be electrically coupled to inner surfaces 721, 723, and 725. In one embodiment, flanges 164, 272, and 168 can contact and be electrically coupled to inner surfaces 721, 723, and 725, respectively.

In some examples, flanges 164, 272, and 168 push in an outward radial direction against inner surfaces 721, 723, and 725, respectively. This force can help maintain contact and electrical coupling between prongs 110, 112, and 114 and conductors 120, 122, and 124, respectively. Moreover, this force can cause conductors 120, 122, and 124 to be outwardly elastically deformed or deflected in some examples.

In the same or a different example, flanges 164, 272, and 168 can have some elasticity and this elasticity can help maintain contact with and apply force to conductors 120, 122, and 124, respectively. In yet another embodiment, prongs 110, 112, and 114 can include a spring mechanism that helps flanges 164, 272, and 168 maintain contact and apply force to conductors 120, 122, and 124, respectively.

When prongs 110, 112, and 114 are rotated about axis 308, a portion of inner surface 721 in contact with prong 110 changes. Likewise, the portions of inner surfaces 723 and 725 in contact with prongs 112 and 114, respectively, also change when prongs 110, 112, and 114 are rotated.

In the embodiment illustrated in FIGS. 1-7, each prong of prongs 110, 112, and 114 has a different length. For example, arm 161 can have a first length, and arm 165 can have a second length, different from the first length. Furthermore, arm 269 can have a third length, different from the first and second lengths.

Housing 330 defines an interior space, which encloses conductors 120, 122, and 124, a portion 651 (FIG. 6) of cable 150, and a portion of prongs 110, 112, and 114. In one embodiment, housing 330 can include: (a) an outer section 131; (b) an outer section 133 adjacent to outer section 131; (c) rotating outer section 132, which is adjacent to outer section 131; and (d) a support portion 145.

In one example, rotating outer section 132, support portion 145, and prongs 110, 112, and 114 are capable of being rotated about axis 308 relative to outer sections 131 and 133 and conductors 120, 122, and 124.

In one example, the interior space of housing 330 is a region interior to outer sections 131 and 133. In the same or a different example, support portion 145 and at least a portion of rotating outer section 132 are located within the interior space of housing 330.

Outer section 131 can include: (a) a main face 134 with an aperture 135; and (b) a portion 136 of a cable receiving aperture 639 (FIG. 6). In one embodiment, rotating outer section 132 is adjacent to aperture 135.

Outer section 133 can include: (a) a main face 137; and (b) a portion 138 of cable receiving aperture 639. In one embodiment, portion 136 and 138 define cable receiving aperture 639. In one example, portion 651 of cable 150 can be located within cable receiving aperture 639.

In some embodiments, outer sections 131 and 133 can also include holes for bolts, screws, rivets or other coupling mechanisms used to couple outer section 131 to outer section 133. In another embodiment, at least a portion of housing 330 is formed using an injection molding process and holes for coupling mechanisms are unnecessary. In yet another embodiment, outer sections 131 and 133 can be coupled using ultrasonic welding or an adhesive.

Rotating outer section 132 is rotatably coupled to outer section 131 and outer section 133 and is rotatable with prongs 110, 112, and 114. That is, rotating outer section 132 and prongs 110, 112, and 114 are capable of being rotated about axis 308 relative to outer sections 131 and 133, insulators 140 and 142, and conductors 120, 122, and 124.

Rotating outer section 132 can include: (a) two or more apertures 180, 181, and 182; (b) two or more slots 284, 285, and 286 (FIG. 2); and (c) face portion 309 (FIG. 3). In one embodiment, each of slots 284, 285, and 286 form a passageway that extends through rotating outer section 132. Slot 286 can extend into aperture 180. Slots 284 and 286 can extend into apertures 182 and 181, respectively.

In one embodiment, prongs 110, 112, and 114 can extend out of rotating outer section 132. For example, slots 284, 285 and 286 can enclose a portion of prongs 114, 112, and 110, respectively. In one embodiment, a portion of arms 161, 165, and 269 extend out of rotating outer section 132 through apertures 180, 181, and 182, respectively. Flanges 164, 168, and 272 can prevent prongs 110, 112, and 114, respectively, from sliding out of electrical connector 100.

In some examples, support portion 145 can be rotated along with rotating outer section 132 and prongs 110, 112, and 114. Additionally, support portion 145 can help maintain contact between prongs 110, 112, and 114 and conductors 120, 122, and 124, respectively. In one example, support portion 145 includes projections 190 and 191 extending from a surface 146. In one embodiment, flanges 272 and 168 are in contact with projections 190 and 191, respectively. In the same or a different embodiment, flange 164 is in contact with surface 146. Projections 190, 191 and surface 146 help maintain flanges 272, 168 and 164 in the same plane as conductors 124, 122, and 120, respectively. In one example, support portion 145 is electrically insulative and can have a circular shape with a radius less than inner radius 775.

In some embodiments, support portion can be coupled to rotating outer section 132. In one example, support portion 145 is coupled to rotating outer section 132 using ultrasonic welding or an adhesive.

Figure 8:
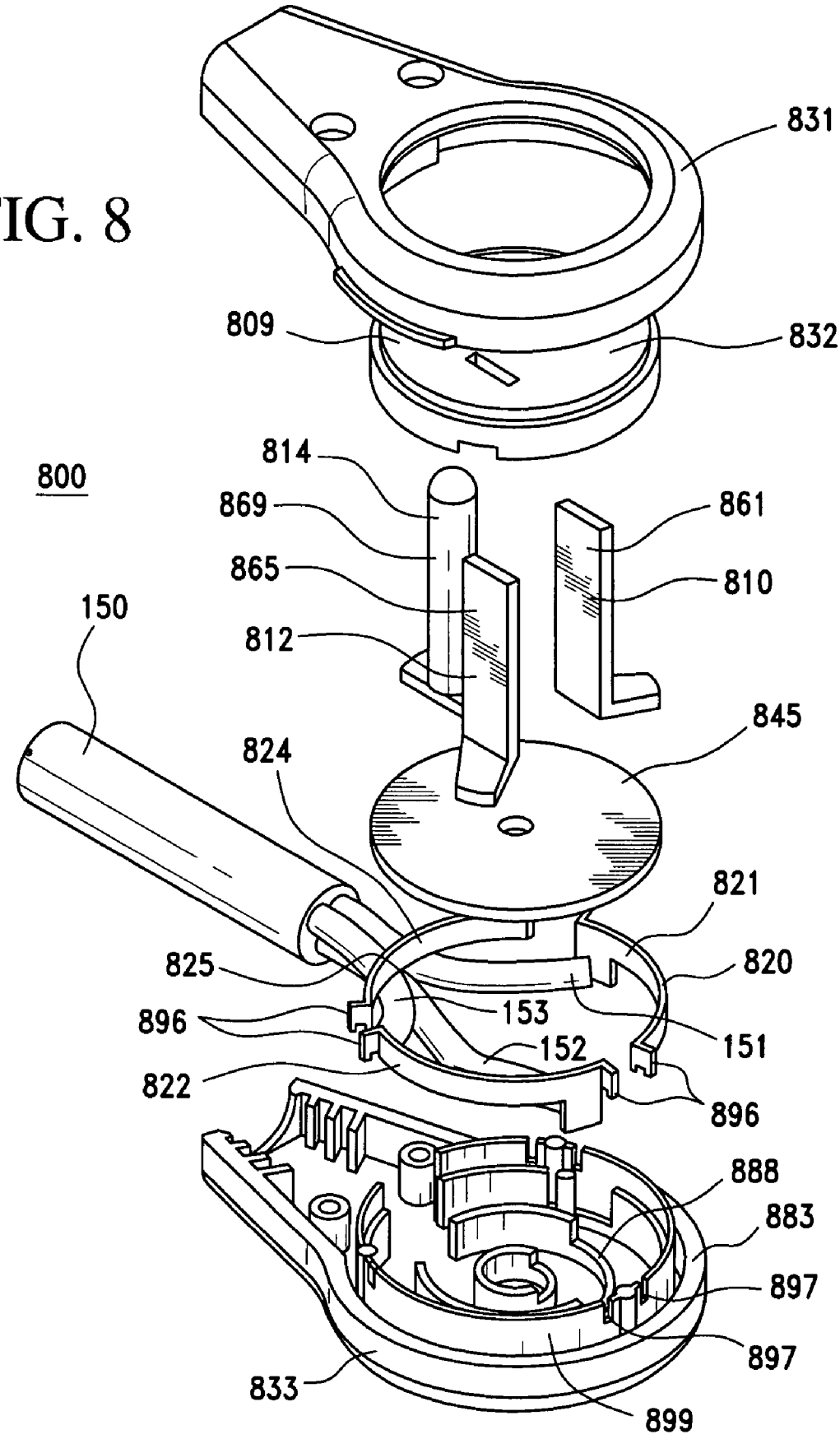
FIG. 8 illustrates an exploded view of an electrical connector, according to a second embodiment.
Figure 9:
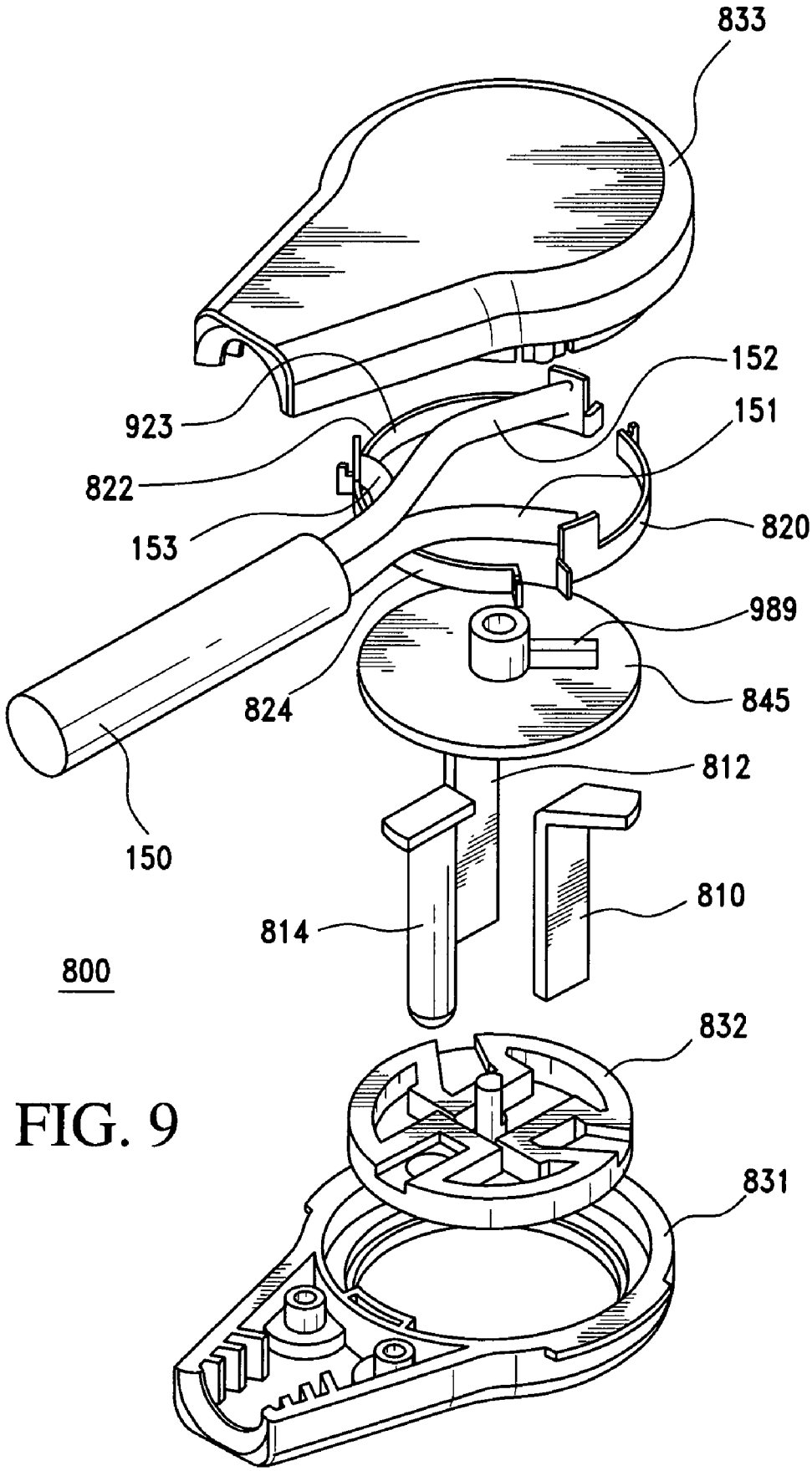
FIG. 9 illustrates another exploded view of the electrical connector of FIG. 8, according to the second embodiment.

Turning to another embodiment, FIG. 8 illustrates an exploded view of an electrical connector 800, according to a second embodiment. FIG. 9 illustrates another exploded view of electrical connector 800, according to the second embodiment. FIG. 10 illustrates a back view of electrical connector 800, according to the second embodiment. FIG. 11 illustrates a cross-sectional view along the III-III line (FIG. 10) of electrical connector 800, according to the second embodiment. FIG. 12 illustrates a cross-sectional view along the IV-IV line (FIG. 10) of electrical connector 800, according to the second embodiment.

Referring to FIGS. 8-12, electrical connector 800 can include: (a) two or more prongs 810, 812, and 814; (b) two or more conductors 820, 822, and 824; (c) cable 150 coupled to conductors 820, 822, and 824; and (d) a housing 1030 (FIG. 10). In one example, electrical wires 151, 152, and 153 are coupled to conductors 820, 822, and 824, respectively.

In some embodiments, housing 1030 can include: (a) an outer section 831; (b) an outer section 833 adjacent to outer section 831; (c) a rotating outer section 832 adjacent to outer section 831; and (d) a support portion 845.

Similar to electrical connector 100, when electrical connector 800 is coupled to an electrical outlet (not shown), a rotating outer section 832, support portion 845, and prongs 810, 812, and 814 can be rotated relative to the electrical outlet. Moreover, prongs 810, 812, and 814 extend out of rotating outer section 832 and are capable of being rotated about an axis 1108 (FIG. 11), which is substantially perpendicular to a face portion 809 of rotating outer section 832. In the embodiment illustrated in FIGS. 8-12, prongs 810, 812, and 814 can be rotated at least ninety degrees and up to one hundred twenty degrees about axis 1108.

In this embodiment, conductors 820, 822, and 824 are located in, or are at least parallel to, the same conductor plane, and each of conductors 820, 822, and 824 forms a portion of a ring. The conductor plane can be substantially perpendicular to axis 1108. In one example, conductors 820, 822, and 824 have inner surfaces 821, 923, and 825, respectively. In this example, prongs 810, 812, and 814 are electrically coupled to inner surface 821, 923 (FIG. 9), and 825, respectively. Accordingly, at least a portion of flanges of prongs 810, 812 and 814 are in or parallel to the conductor plane.

In this embodiment, prongs 810 and 812 are the same length because conductors 820 and 822 are located in the same plane. Prong 814 can be longer than prongs 810 and 812. In one example, prong 814 is longer because of UL Safety Standards require the ground prong to be longer than the other prongs. In one example, arms 861 and 865 of prongs 810 and 812, respectively, have a first length. Arm 869 of prong 814 can have a second length, greater than the first length. In other embodiments, prongs 810, 812, and 814 have the same length.

In some examples, outer section 833 can include one or more protrusions 899 capable of holding or securing cable 150 and conductors 820, 822, and 824. For example, each of conductors 820, 822, and 824 can include one or more protrusions 896 that allow conductors 820, 822, and 824 to be coupled to one or more slots 897 in protrusions 899.

In this embodiment, support portion 845 can help limit the angle that electrical connector 800 can rotate around axis 1108. In one example, support portion 845 includes a stopper 989 (FIG. 9). Outer section 833 can include at least one notch 888 to which stopper 989 contacts. Notch 888 is designed such that, when support portion 845 is rotated, notch 888 restricts the movement of stopper 989 and support portion 845 to approximately ninety degrees up to one hundred twenty degrees. In one example, notch 888 is a decrease in height in the annular rib or wall over a given angular distance. In other examples, other mechanisms or methods can be used to limit the angle at which electrical connector 800 can rotate around axis 1108.

Figure 13:
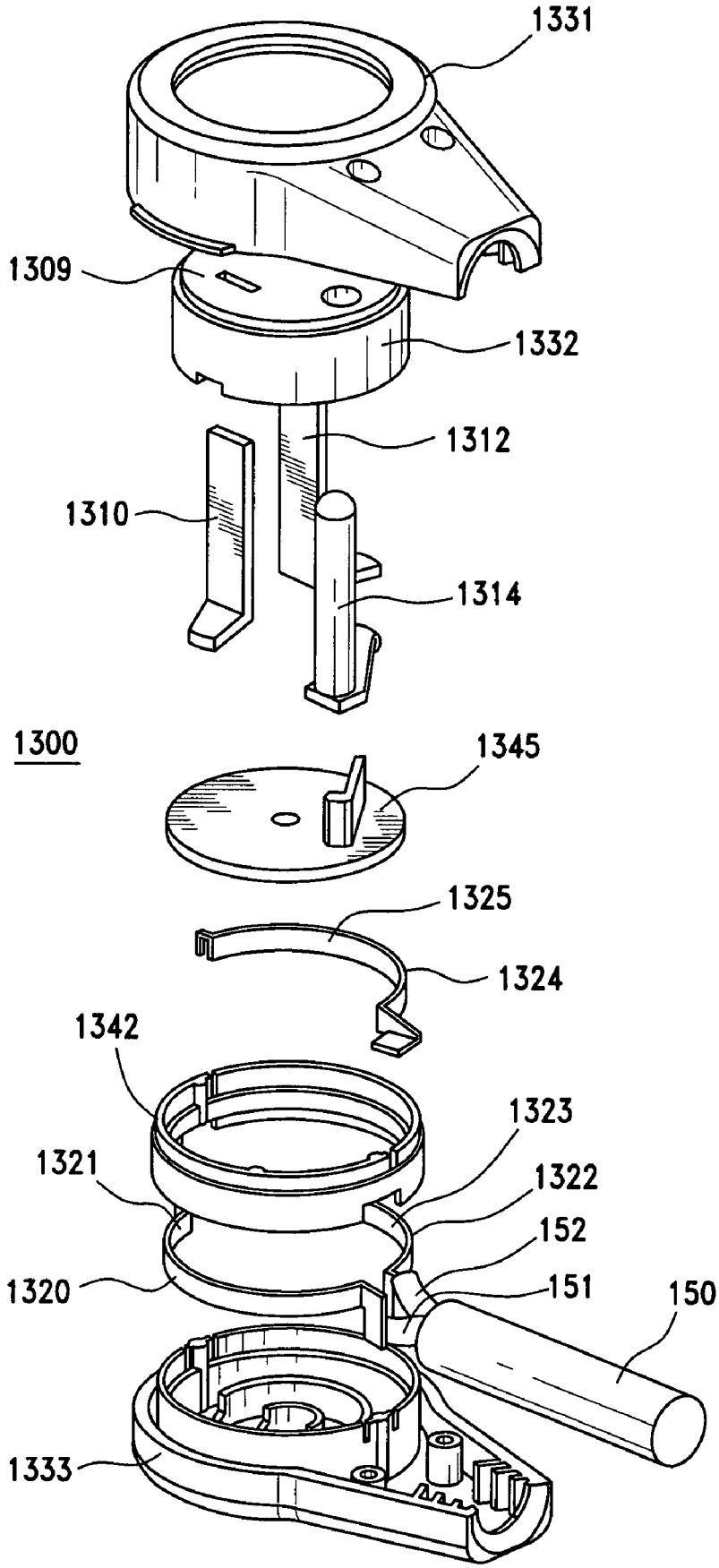
FIG. 13 illustrates an exploded view of an electrical connector, according to a third embodiment.
Figure 14:
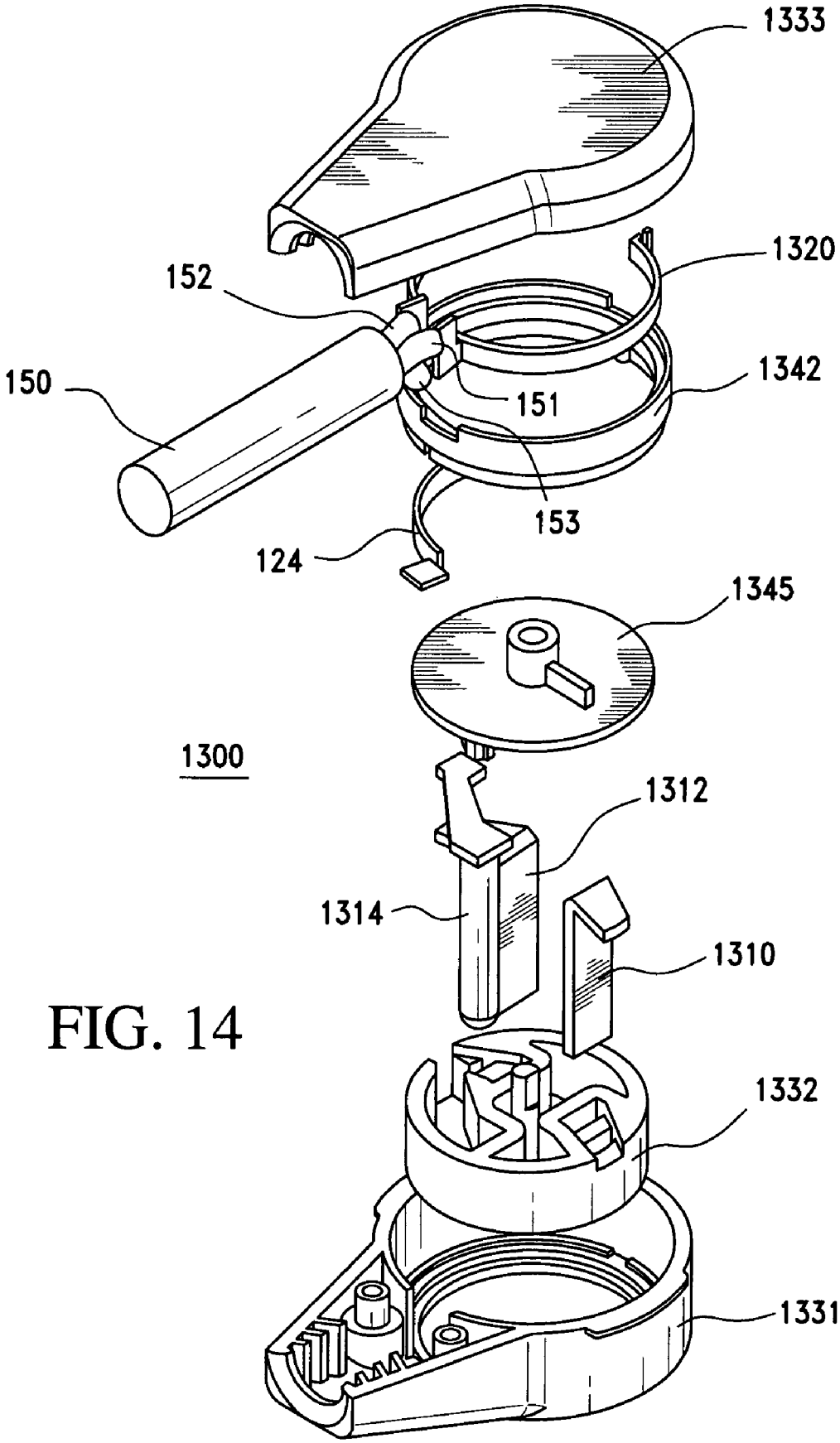
FIG. 14 illustrates another exploded view of the electrical connector of FIG. 13, according to the third embodiment.

Turning to a further embodiment, FIG. 13 illustrates an exploded view of an electrical connector 1300, according to a third embodiment. FIG. 14 illustrates another exploded view of electrical connector 1300, according to the third embodiment. FIG. 15 illustrates a back view of electrical connector 1300, according to the third embodiment. FIG. 16 illustrates a cross-sectional view along the V-V line (FIG. 15) of electrical connector 1300, according to the third embodiment. FIG. 17 illustrates a cross-sectional view along the VI-VI line (FIG. 15) of electrical connector 1300, according to the third embodiment.

Referring to FIGS. 13-17, electrical connector 1300 can include: (a) two or more prongs 1310, 1312, and 1314; (b) two or more conductors 1320, 1322, and 1324; (c) cable 150 with electrical wires 151, 152, and 153; (d) an insulator 1342; and (e) a housing 1530 (FIG. 15). In one example, electrical wires 151, 152, and 153 are coupled to conductors 1320, 1322, and 1324, respectively. In the same or a different example, conductors 1320, 1322, and 1324 can have inner surfaces 1321, 1323, and 1325, respectively.

In some embodiments, housing 1530 can include: (a) an outer section 1331; (b) an outer section 1333 adjacent to outer section 1331; (c) a rotating outer section 1332 adjacent to outer section 1331; and (d) a support portion 1345.

Similar to electrical connectors 100 and 800, when electrical connector 1300 is coupled to an electrical outlet (not shown), prongs 1310, 1312, and 1314, rotating outer section 1332, and support portion 1345 can be rotated relative to the electrical outlet. Moreover, prongs 1310, 1312, and 1314 extend out of rotating outer section 1332 and are capable of being rotated about an axis 1608 (FIG. 16) that is substantially perpendicular to a face portion 1309 of rotating outer section 1332. In the embodiment illustrated in FIGS. 13-17, prongs 1310, 1312, and 1314 can be rotated at least one hundred and twenty degrees and up to one hundred eighty degrees about axis 1608.

In this embodiment, conductors 1320 and 1322 are in or at least parallel to a first plane, and conductor 1324 is in or at least parallel to a second plane. The first plane and the second plane are substantially perpendicular to axis 1608. In one example, the first plane is substantially parallel to the second plane.

In the embodiment illustrated in FIGS. 13-17, prongs 1310, 1312, and 1314 are electrically coupled to and in contact with inner surface 1321, 1323, and 1325, respectively. In this embodiment, insulator 1342 isolates conductors 1320 and 1322 from conductor 1324 and vice versa. In some examples, insulator 1342 is substantially similar or identical to insulators 140 and 142.

In this embodiment, conductor 1320 can include a portion of a first ring. Conductor 1322 can include a portion of a second ring. Conductor 1324 can include a portion of a third ring. In one embodiment, conductors 1320, 1322, and 1324 have the same radius. In the same or a different embodiment, conductors 1320, 1322, and 1324 are concentric. In alternative embodiments, conductor 1320 includes a first portion of a first ring and conductor 1322 includes a second portion of the first ring.

In this embodiment, prongs 1310 and 1312 can have a first length and prong 1314 can have a second length. In one example, the second length is less than the first length. In an alternative embodiment, the second length is greater than or equal to the first length.

Figure 18:
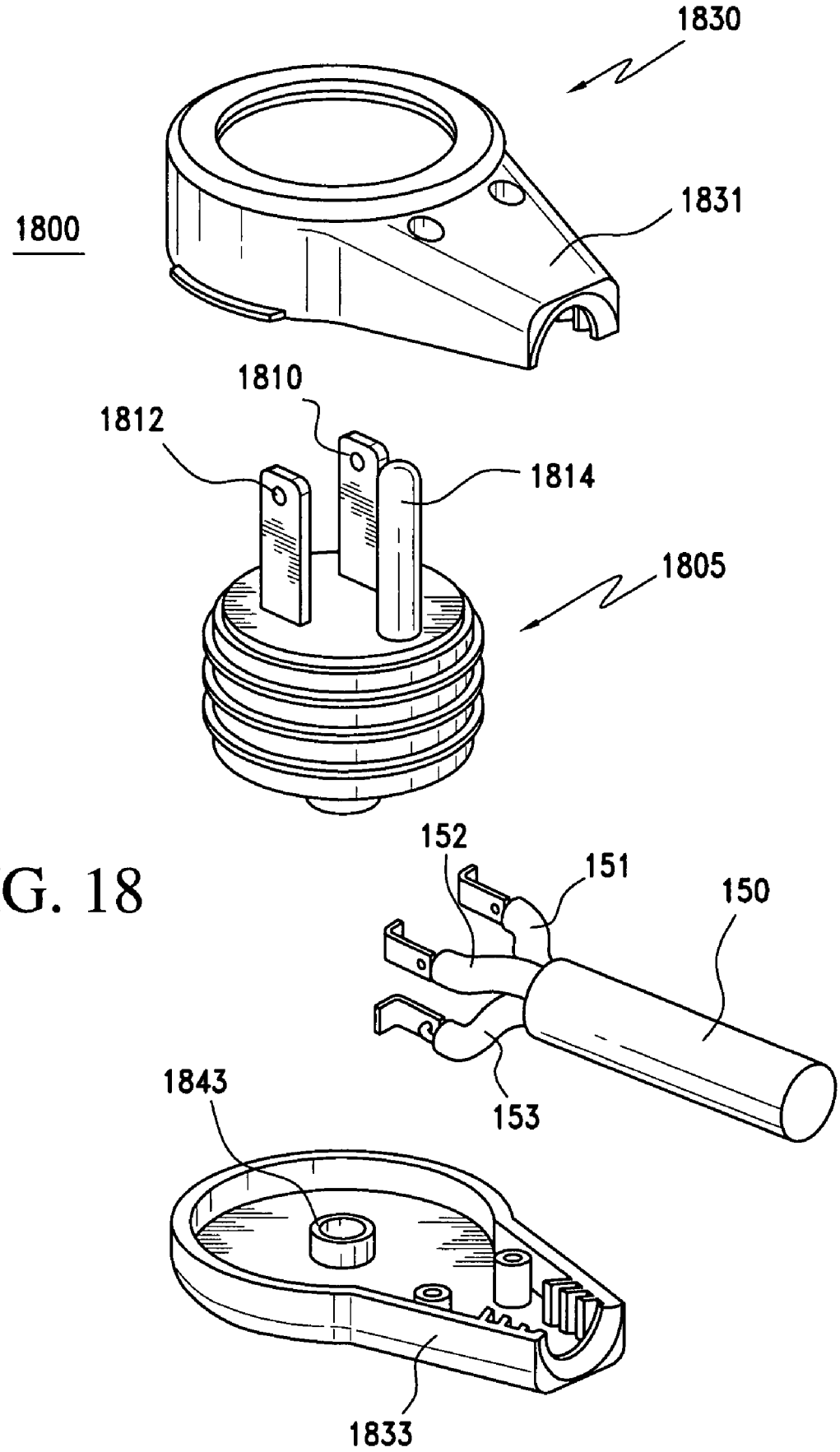
FIG. 18 illustrates a partially exploded view of an electrical connector, according to a forth embodiment.
Figure 19:
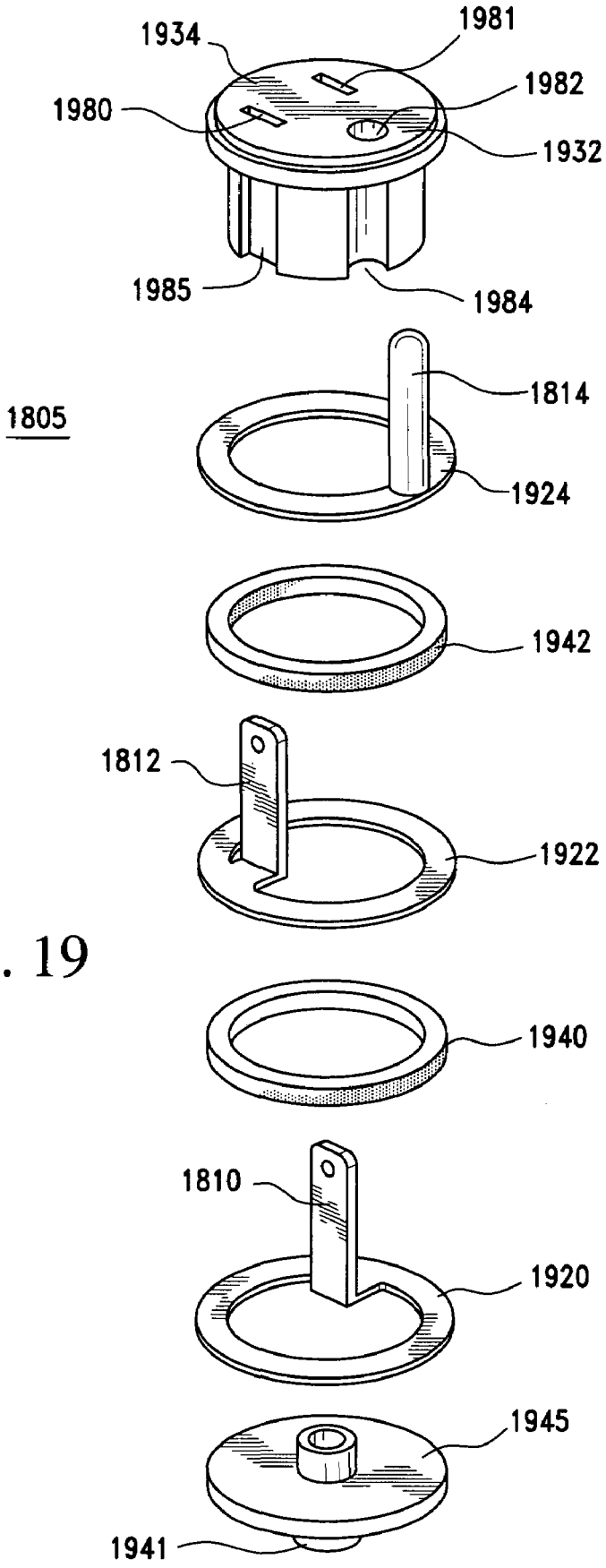
FIG. 19 illustrates an exploded view of a body of the electrical connector of FIG. 18, according to the forth embodiment.

Turning to yet another embodiment, FIG. 18 illustrates a partially exploded view of an electrical connector 1800, according to a fourth embodiment. FIG. 19 illustrates an exploded view a body 1805 of electrical connector 1800, according to the fourth embodiment.

Referring to FIGS. 18-19, electrical connector 1800 can include (a) two or more prongs 1810, 1812, and 1814; (b) two or more conductors 1920, 1922, and 1924; (c) cable 150 with electrical wires 151, 152, and 153; (d) one or more insulators 1940 and 1942; and (e) a housing 1830. In one example, electrical wires 151, 152, and 153 are coupled to conductors 1920, 1922, and 1924, respectively.

Housing 1830 can include: (a) an outer section 1833; (b) an outer section 1831 adjacent to outer section 1833; (c) a rotating outer section 1932 adjacent to outer section 1833; (d) main face 1934; and (e) a support portion 1945.

In one example, rotating outer section 1932 includes: (a) two or more slots 1984, 1985, and 1986 (not shown); and (b) two or more apertures 1980, 1981, and 1982. In one example, slots 1984, 1985, and 1986 extend into apertures 1982, 1980, and 1981, respectively. In the same or a different embodiment, slot 1986 is substantially similar or identical to slot 1984 and/or 1985.

When electrical connector 1800 is coupled to an electrical outlet (not shown), body 1805 can be rotated relative to the electrical outlet. Moreover, prongs 1810, 1812, and 1814 extend out of rotating outer section 1932 and are capable of being rotated about an axis substantially perpendicular to main face 1934. In the embodiment illustrated in FIGS. 18-19, prongs 1810, 1812, and 1814 can be rotated at least three hundred and sixty degrees about the axis.

Insulator 1940 electrically isolates conductor 1924 from conductor 1922 and vice versa. Insulator 1942 electrically isolates conductor 1920 from conductor 1922 and vice versa. In this embodiment, conductors 1920, 1922, and 1924 and insulators 1940 and 1942 can have a substantially annular shape. In one example, conductors 1920, 1922, and 1924 and insulators 1940 and 1942 have the same radius. In the same or a different example, conductors 1920, 1922, and 1924 and insulators 1940 and 1942 can be concentric.

In one embodiment, prong 1812 can be coupled to the interior or inside surface of conductor 1922. Prong 1812 can extend through a slot 1985 with a portion of prong 1812 extending out of aperture 1980. Likewise, prong 1810 can be coupled to the interior or inside surface of conductor 1920. Prong 1810 can extend through slot 1986 with a portion of prong 1810 extending out of aperture 1981.

In the same or a different embodiment, prong 1814 is coupled to a top side of conductor 1924. Prong 1814 can extend through a slot 1984 with a portion of prong 1812 extending out of aperture 1982. In other embodiments, prong 1814 can be coupled to the interior or inside surface of conductor 1924.

In one embodiment, prong 1810 and conductor 1920 can form a unitary structure. Likewise, prong 1812 and conductor 1922 can have a unitary structure with prong 1812 coupled to conductor 1922. In the same or a different example, prong 1814 and conductor 1924 can also have a unitary structure.

In alternative embodiments, prongs 1810, 1812, and 1814 do not have a unitary structure with conductors 1920, 1922, and 1924, respectively. In one example, prongs 1810, 1812, and 1814 are soldered to conductors 1920, 1922, and 1924, respectively.

Support portion 1945 is coupled to conductor 1920 and rotatably coupled to outer section 1833. In one example, support portion 1945 is also coupled to rotating outer section 1932 to hold body 1805 together. In some embodiments, support portion 1945 is coupled to rotating outer section 1932 by ultrasonic welding or with an adhesive.

Support portion 1945 can include a coupling mechanism 1941 that can be coupled to a coupling mechanism 1843 at outer section 1833. Coupling mechanism 1941 can help facilitate rotation of body 1805 in relation to outer sections 1831 and 1833.

Figure 20:
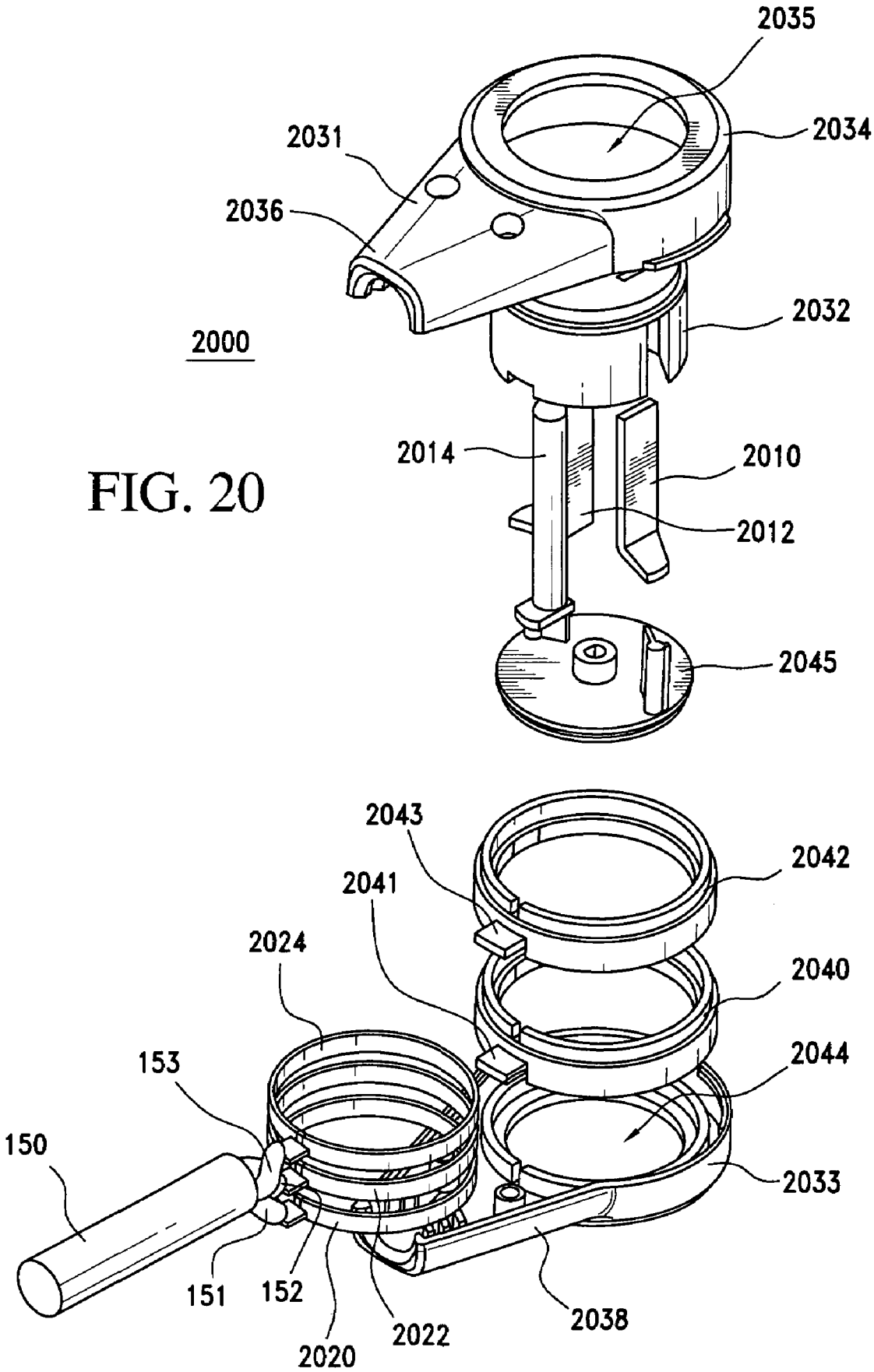
FIG. 20 illustrates an exploded view of an electrical connector, according to a fifth embodiment.
Figure 21:
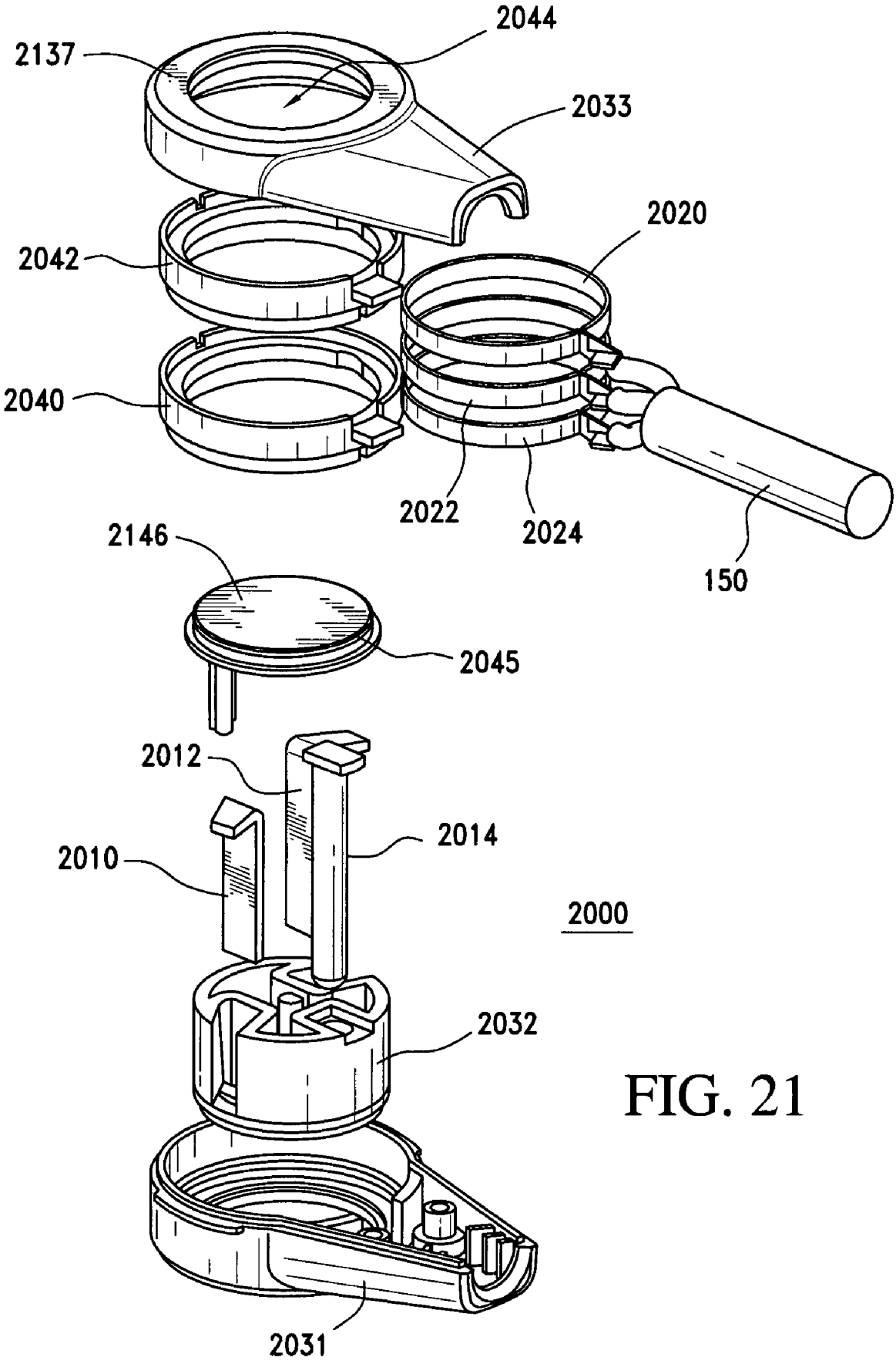
FIG. 21 illustrates another exploded view of the electrical connector of FIG. 20, according to the fifth embodiment.
Figure 22:
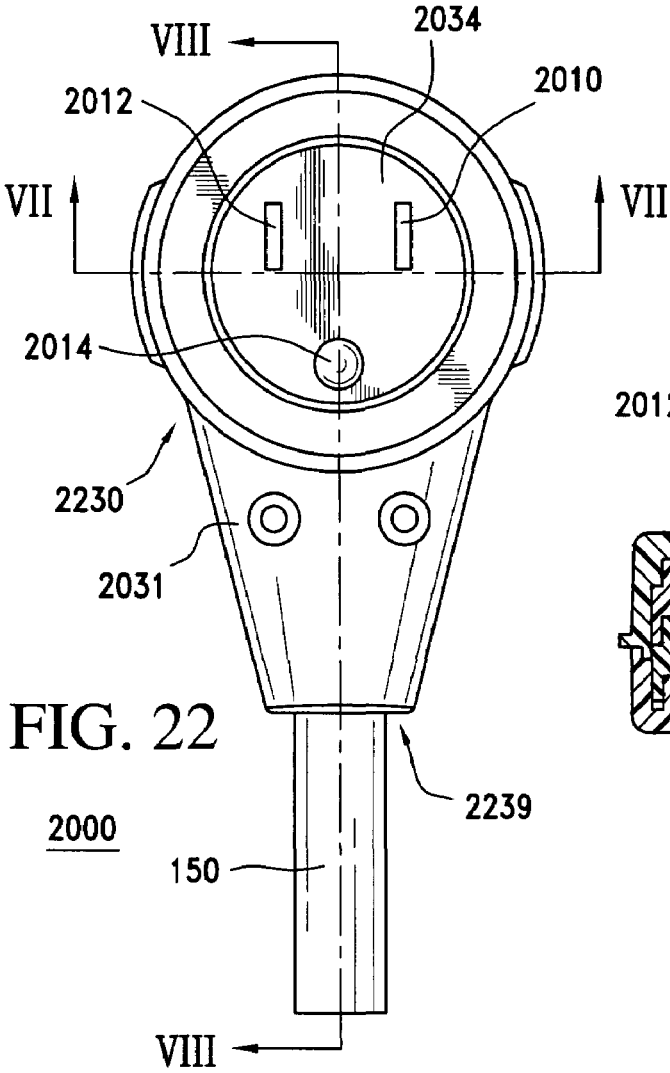
FIG. 22 illustrates a back view of the electrical connector of FIG. 20, according to the fifth embodiment.
Figure 23:
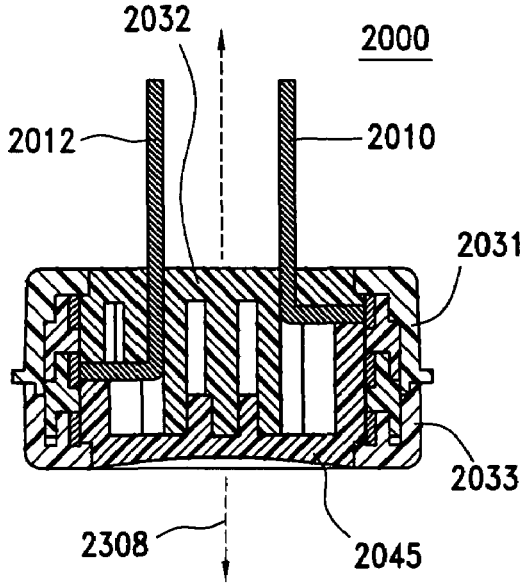
FIG. 23 illustrates a cross-sectional view along the VII-VII line of FIG. 22 of the electrical connector of FIG. 20, according to the fifth embodiment.
Figure 24:
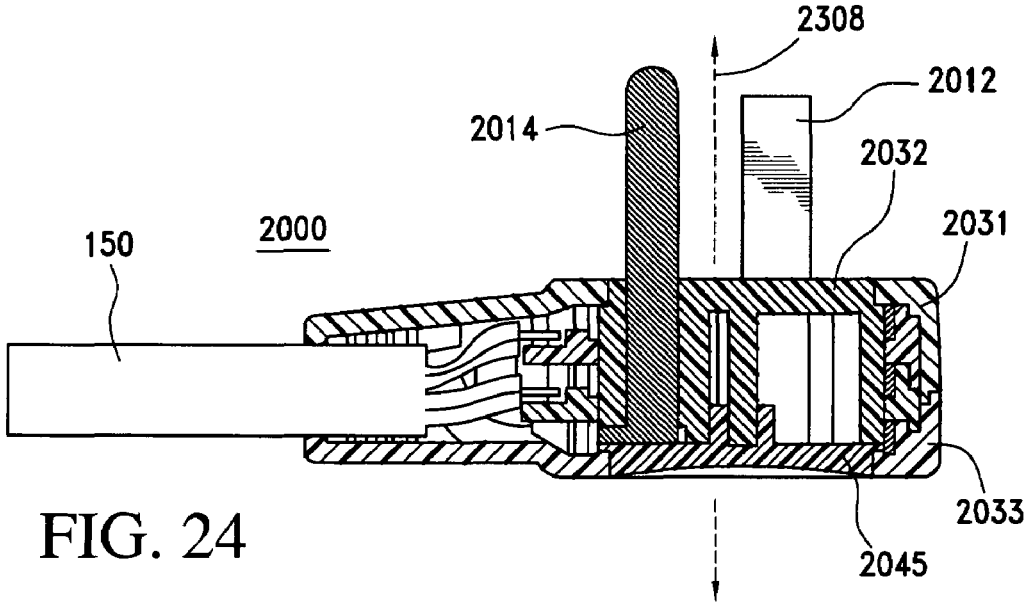
FIG. 24 illustrates a cross-sectional view along the VIII-VIII line of FIG. 22 of the electrical connector of FIG. 20, according to the fifth embodiment.

Turning to a further embodiment, FIG. 20 illustrates an exploded view of an electrical connector 2000, according to a fifth embodiment. FIG. 21 illustrates another exploded view of electrical connector 2000, according to the fifth embodiment. FIG. 22 illustrates a back view of electrical connector 2000, according to the fifth embodiment. FIG. 23 illustrates a cross-sectional view along the VII-VII line (FIG. 22) of electrical connector 2000, according to the fifth embodiment. FIG. 24 illustrates a cross-sectional view along the VIII-VIIII line (FIG. 22) of electrical connector 2000, according to the fifth embodiment.

In this embodiment, electrical connector 2000 is similar to electrical connector 100 (FIG. 1). In the example shown in FIGS. 20-24, electrical connector 2000 can include: (a) one or more electrical prongs 2010, 2012, and 2014; (b) one or more conductors 2020, 2022, and 2024 (c) one or more electrical insulators 2040 and 2042; (d) cable 150 having two or more electrical wires 151, 152, and 153; (e) a housing 2230 (FIG. 22) with a rotating outer section 2032. In one example, electrical wires 151, 152, and 153 are coupled to conductors 2020, 2022, and 2024, respectively. In the embodiment illustrated in FIGS. 20-24, prongs 2010, 2012, and 2014 can be rotated at least three-hundred and sixty degrees about axis 2308.

In this embodiment, prong 2014 has a first length, and prongs 2010 and 2012 have a second length. In one example, the first length is greater than a second length. Also, in this embodiment, insulators 2040 and 2042 include overhang portions 2041 and 2043, respectively. Overhang portions 2041 and 2043 help electrically isolate electrical wires 151, 152, and 153 from each other.

Also, in this embodiment, housing 2230 can include: (a) an outer section 2031; (b) an outer section 2033 adjacent to outer section 2031; (c) a support portion 2045; and (d) rotating outer section 2032.

Outer section 2031 can include: (a) a main face 2034 with an aperture 2035; and (b) a portion 2036 of a cable receiving aperture 2239 (FIG. 22). Outer section 2033 can include: (a) a main face 2137 with an aperture 2044; and (b) a portion 2038 of cable receiving aperture 2239.

Rotating outer section 2032 can be adjacent to aperture 2035, and support portion 2045 can be adjacent to aperture 2044. In one example, support portion 2045 is coupled to rotating outer section 2032. In some embodiments, a portion of a face 2146 (FIG. 21) of support portion 2045 does not rotate when prongs 2010, 2012, and 2014 are rotated relative to outer sections 2031 and 2033.

Figure 25:
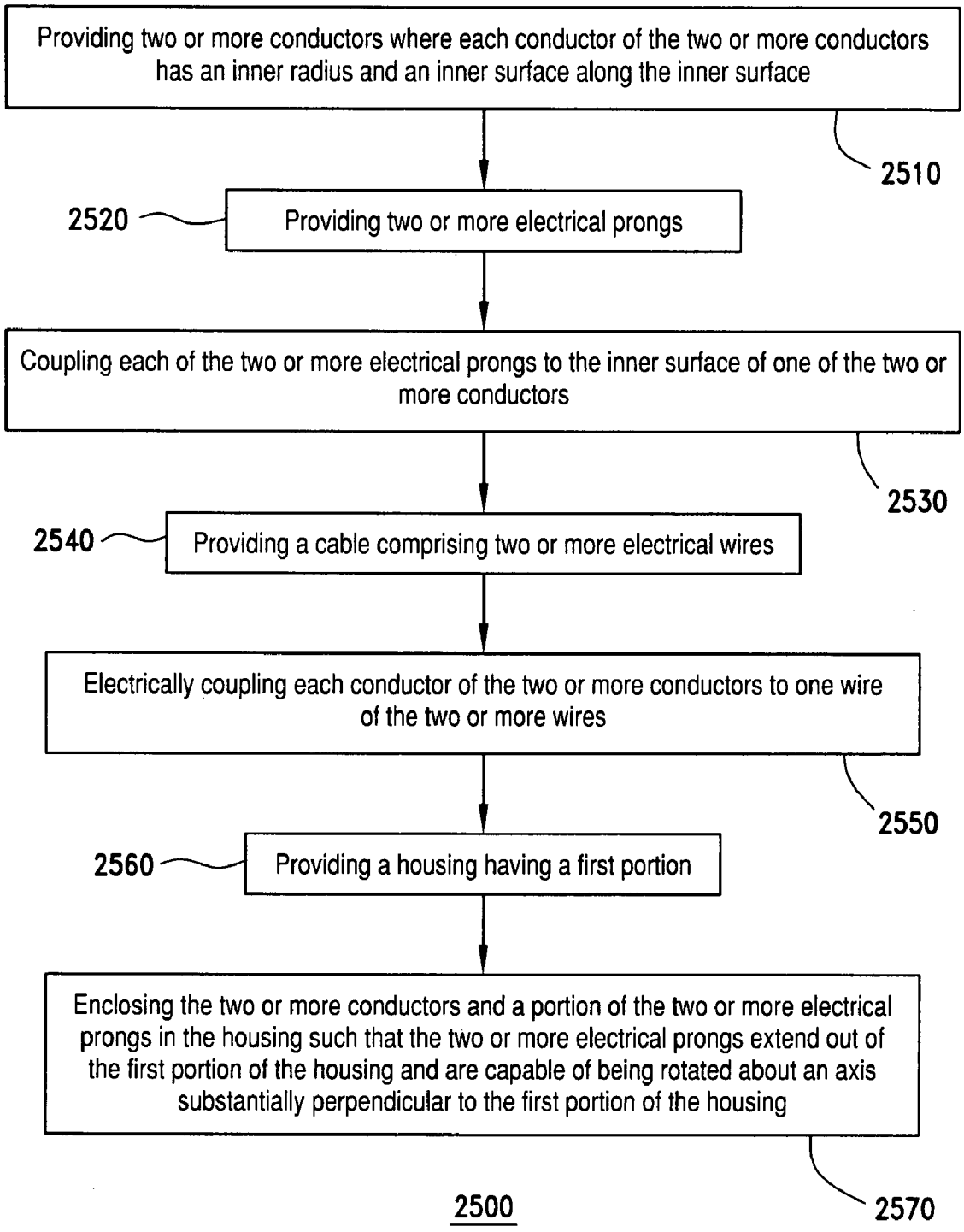
FIG. 25 illustrates a flow chart for a method of manufacturing a rotatable electrical connector, according to an embodiment.

FIG. 25 illustrates a flow chart 2500 for a method of manufacturing a rotatable electrical connector, according to an embodiment. Flow chart 2500 includes a step 2510 of providing two or more conductors where each conductor of the two or more conductors has an inner radius and an inner surface along the inner radius. As an example, the two or more conductors can be similar to conductors 120, 122, and 124 of FIG. 1, conductors 820, 822, and 824 of FIG. 8, conductors 1320, 1322, and 1324 of FIG. 1, conductors 1920, 1922, and 1924 of FIG. 19, and/or conductors 2020, 2022, and 2024 of FIG. 20.

Flow chart 2500 in FIG. 25 continues with a step 2520 of providing two or more electrical prongs. As an example, the two or more electrical prongs can be similar to prongs 110, 112, and 114 of FIG. 1, prongs 810, 812, and 814 of FIG. 8, prongs 1310, 1312, and 1314 of FIG. 13, prongs 1810, 1812, and 1814 of FIG. 18, and/or prongs 2010, 2012, and 2014 of FIG. 20.

Subsequent, flow chart 2500 includes a step 2530 of coupling each of the two or more electrical prongs to the inner surface of one of the two or more conductors. As an example, coupling each of the two or more electrical prongs to the inner surface of one of the two or more conductors can be similar to prongs 110, 112, and 114 contacting and being electrically coupled to conductors 120, 122, and 124, respectively, as shown in FIGS. 5 and 6. Furthermore, coupling each of the two or more electrical prongs to the inner surface of one of the two or more conductors can be similar to the coupling of prongs 810, 812, and 814 to conductors 820, 822, and 824, respectively, as shown in FIGS. 11 and 12. In yet another example, coupling each of the two or more electrical prongs to the inner surface of one of the two or more conductors can be similar to the coupling of prongs 1310, 1312, and 1314 to conductors 1320, 1322, and 1324, respectively, as shown in FIGS. 16 and 17. In still a further example, coupling each of the two or more electrical prongs to the inner surface of one of the two or more conductors can be similar to the coupling of prongs 2010, 2012, and 2014 to conductors 2020, 2022, and 2024, respectively, as shown in FIGS. 23 and 24.

Next, flow chart 2500 includes a step 2540 of providing a cable comprising two or more electrical wires. As an example, the cable can be similar to cable 150 as shown in FIGS. 1-4, 6-10, 12-15, 17-22, and 25. The two or more electrical wires can be similar to electrical wires 151, 152, and 153, as shown in FIGS. 1-2, 7-9, 13-14, 18 and 20-21.

Flow chart 2500 continues with a step 2550 of electrically coupling each conductor of the two or more conductors to one wire of the two or more wires. As an example, electrically coupling each conductor of the two or more conductors to one wire of the two or more wires can be similar to the coupling of electrical wires 151, 152, and 153 to conductors 120, 122, and 124, respectively, as shown in FIGS. 1, 2, and 7. In another example, electrically coupling each conductor of the two or more conductors to one wire of the two or more wires can be similar to the coupling of electrical wires 151, 152, and 153 to conductors 820, 822, and 824, respectively, as shown in FIGS. 8 and 9. In still another example, electrically coupling each conductor of the two or more conductors to one wire of the two or more wires can be similar to the coupling of electrical wires 151, 152, and 153 to conductors 1320, 1322, and 1324, respectively, as partially shown in FIG. 17. In a further example, electrically coupling each conductor of the two or more conductors to one wire of the two or more wires can be similar to the coupling of electrical wires 151, 152, and 153 to conductors 1920, 1922, and 1924, respectively. In an additional example, electrically coupling each conductor of the two or more conductors to one wire of the two or more wires can be similar to the coupling of electrical wires 151, 152, and 153 to conductors 2020, 2022, and 2024, as shown in FIGS. 20 and 21.

Subsequently, flow chart 2500 includes a step 2560 of providing a housing having a first portion. As an example, the housing can be similar to housings 330, 1030, 1530, 1830, and 2230 of FIGS. 3, 10, 15, 18, and 22, respectively. The first portion can be similar to rotating outer sections 132, 832, 1332, 1932, and 2032 of FIGS. 1, 8, 13, 19, and 20, respectively.

Subsequently, flow chart 2500 includes a step 2570 of enclosing the two or more conductors and a portion of the two or more electrical prongs in the housing such that the two or more electrical prongs extend out of the first portion of the housing and are capable of being rotated about an axis substantially perpendicular to the first portion of the housing. The electrical connector after enclosing the two or more conductors and a portion of the two or more electrical prongs can be similar to electrical connectors 100, 800, 1300, and 2000 shown in FIGS. 3, 11, 16, and 22, respectively.

Although the invention has been described with reference to specific embodiments, it will be understood by those skilled in the art that various changes may be made without departing from the spirit or scope of the invention. For example, to one of ordinary skill in the art, it will be readily apparent that the electrical connector can be an electrical plug that conforms to European or other countries' standards, instead of a plug that conforms to United States standards. In another example, the electrical connector is a two prong connector, instead of a three prong connector. In a further example, the conductors have a non-annular and/or irregular shape. In yet another example, the housing can be referred to as a casing and sections can be referred to as portions. In a further example, rotating outer housing can be referred to as a plug face portion. In still another example, the conductors can have a number of different shapes as long as the prongs can maintain contact and electrical coupling with the conductors while the prongs are rotated. In one embodiment, the conductors can be at least a portion of a twenty sided polygon. In a yet further example, at least one conductor of conductors has a shape different than the other two conductors. Additional examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims.

For example, to one of ordinary skill in the art, it will be readily apparent that the electrical connector and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An electrical connector comprising:

two or more conductors, each conductor of the two or more conductors has an inner radius and an inner surface along the inner radius;

two or more electrical prongs, each prong of the two or more electrical prongs contacts and is electrically coupled to the inner surface of one of the two or more conductors; and a housing having a first portion and enclosing the two or more conductors and a first portion of each of the two or more electrical prongs, wherein:

a second portion of each of the two or more electrical prongs is capable of being inserted into an electrical outlet;

the two or more electrical prongs extend out of the first portion of the housing and are capable of being rotated about an axis substantially perpendicular to the first portion of the housing;

the two or more conductors are substantially stationary relative to the axis when the two or more electrical prongs are rotated; and the two or more conductors comprise:

a first conductor comprising a first portion of a first ring;

a second conductor comprising a second portion of the first ring; and a third conductor comprising a third portion of a second ring.

2. The electrical connector of claim 1, wherein:

the two or more conductors are parallel to two or more planes in the housing; and the two or more planes are substantially perpendicular to the axis.

3. The electrical connector of claim 1, wherein:

a second portion of the housing and the two or more electrical prongs are capable of being rotated about the axis relative to a third portion of the housing and the two or more conductors.

4. The electrical connector of claim 1, further comprising:

a cable comprising two or more electrical wires, wherein:

a portion of the cable is enclosed in the housing; and each conductor of the two or more conductors is electrically coupled to one wire of the two or more wires.

5. The electrical connector of claim 1, wherein:

each prong of the two or more electrical prongs comprises:

an arm having a distal end and a proximal end opposite the distal end; and a flange coupled to the proximal end of the arm.

6. The electrical connector of claim 5, wherein:

the inner surface of each of the two or more conductors contacts and is electrically coupled to the flange of one of the two or more electrical prongs; and the second portion of each prong of the two more electrical prongs comprises the distal end of each arm.

7. The electrical connector of claim 5, wherein:

the arm of a first prong of the two or more electrical prongs has a first length; and the arm of a second prong of the two or more electrical prongs has a second length, different from the first length.

8. The electrical connector of claim 7, wherein:

the arm of a third prong of the two or more electrical prongs has a third length, different from the first and second lengths.

9. The electrical connector of claim 7, wherein:

the arm of a third prong of the two or more electrical prongs has the first length.

10. The electrical connector of claim 1, wherein:

the housing comprises:

a first outer portion;

a second outer portion comprising a main face, the main face having an aperture; and a plug face portion adjacent to the aperture in the main face of the second outer portion; and the first portion of the housing comprises the plug face portion.

11. The electrical connector of claim 10, wherein:

the plug face portion is rotatably coupled to the first outer portion and the second outer portion and is rotatable with the two or more electrical prongs.

12. The electrical connector of claim 10, further comprising:

a cable coupled to the two or more conductors, wherein:

the first outer portion of the housing forms a first portion of a cable receiving aperture;

the second outer portion of the housing forms a second portion of the cable receiving aperture; and a portion of the cable is located within the cable receiving aperture.

13. The electrical connector of claim 1, wherein:

a first prong of the two or more electrical prongs contacts a first portion of the inner surface of a first one of the two or more conductors;

the first prong of the two or more electrical prongs contacts at least a second portion of the inner surface of the first one of the two or more conductors when the two or more electrical prongs are rotated about the axis;

a second prong of the two or more electrical prongs contacts a first portion of the inner surface of a second one of the two or more conductors; and the second prong of the two or more electrical prongs contacts at least a second portion of the inner surface of the second one of the two or more conductors when the two or more electrical prongs are rotated about the axis.

14. The electrical connector of claim 1, wherein:

the two or more prongs can rotate at least one hundred and twenty degrees about the axis.

15. The electrical connector of claim 1, wherein:

the two or more prongs can rotate at least ninety degrees about the axis.

* * * * *